US008125390B2

(12) United States Patent
Kuramoto et al.

(10) Patent No.: US 8,125,390 B2
(45) Date of Patent: Feb. 28, 2012

(54) SMALL-SIZE WIDE BAND ANTENNA AND RADIO COMMUNICATION DEVICE

(75) Inventors: Akio Kuramoto, Tokyo (JP); Takuji Mochizuki, Kanagawa (JP)

(73) Assignees: NEC Corporation, Tokyo (JP); Renesas Electronics Corporation, Kanagawa (JP)

( * ) Notice: Subject to any disclaimer, the term of this patent is extended or adjusted under 35 U.S.C. 154(b) by 821 days.

(21) Appl. No.: 12/279,235

(22) PCT Filed: Feb. 15, 2007

(86) PCT No.: PCT/JP2007/052713

§ 371 (c)(1),
(2), (4) Date: Aug. 13, 2008

(87) PCT Pub. No.: WO2007/094402

PCT Pub. Date: Aug. 23, 2007

(65) Prior Publication Data

US 2010/0231477 A1 Sep. 16, 2010

(30) Foreign Application Priority Data

Feb. 16, 2006 (JP) ..... 2006-039340
Aug. 22, 2006 (JP) ..... 2006-225369

(51) Int. Cl.
*H01Q 1/38* (2006.01)

(52) U.S. Cl. ..... 343/700 MS; 343/795; 343/829; 343/830; 343/831; 343/702; 343/793

(58) Field of Classification Search ..... 343/700 MS, 343/702, 795, 797, 829–830, 863, 793
See application file for complete search history.

(56) References Cited

U.S. PATENT DOCUMENTS 6,624,793 B1 * 9/2003 Su et al. ..... 343/795
(Continued)

FOREIGN PATENT DOCUMENTS

EP 1158602 A 11/2001
(Continued)

OTHER PUBLICATIONS

International Search Report for PCT/JP2007/052713 mailed May 29, 2007.

(Continued)

*Primary Examiner* — Jacob Y Choi
*Assistant Examiner* — Shawn Buchanan
(74) *Attorney, Agent, or Firm* — Young & Thompson

(57) ABSTRACT

A small-size wide-band antenna (103) includes a radiation element formed on a dielectric substrate (1) and a coaxial cable (2) as power supply unit for supplying dipole potential to the radiating element. The radiation element includes a ground potential unit to which ground potential is supplied via an external conductor (4) of the coaxial cable and an opposite-pole potential unit to which a potential forming a pair with the ground potential is supplied via a center conductor (3) of the coaxial cable. The ground potential unit includes a pair of conductors (13,14) formed in a tapered shape on the front and rear surfaces of the dielectric substrate and mutually capacitively coupled. The opposite-pole potential unit includes a pair of conductors (31,32) formed in a tapered shape on the front and rear surfaces of the dielectric substrate and mutually capacitively coupled. Each of the ground potential unit and opposite-pole potential unit has a power supply point at a tapered apex of the conductor (13,31). The small-size wide-band antenna (103) further includes a stub conductor (17) as an impedance matching unit for matching the impedance between the radiation element and power supply unit.

19 Claims, 19 Drawing Sheets

U.S. PATENT DOCUMENTS

| | | | | |
|---|---|---|---|---|
| 6,801,170 | B2 * | 10/2004 | Forrester et al. | 343/702 |
| 2002/0033772 | A1 * | 3/2002 | Johnson et al. | 343/702 |
| 2002/0126049 | A1 * | 9/2002 | Okabe et al. | 343/700 MS |
| 2004/0080464 | A1 * | 4/2004 | Suganthan et al. | 343/795 |
| 2004/0164903 | A1 | 8/2004 | Tarn | |
| 2005/0116869 | A1 * | 6/2005 | Siegler et al. | 343/749 |
| 2005/0162332 | A1 * | 7/2005 | Schantz | 343/795 |

FOREIGN PATENT DOCUMENTS

| | | | |
|---|---|---|---|
| EP | 1229605 | A | 8/2002 |
| JP | 60-214605 | A | 10/1985 |
| JP | 2002164731 | A | 6/2002 |
| JP | 2002271129 | A | 9/2002 |
| JP | 2004166087 | A | 6/2004 |
| JP | 2005203971 | A | 7/2005 |
| JP | 2005204179 | A | 7/2005 |
| JP | 2005311685 | A | 11/2005 |
| JP | 2005333571 | A | 12/2005 |
| WO | 2005122333 | A | 12/2005 |

OTHER PUBLICATIONS

Michitaka Ameya et al., "Broadband Printed Dipole Antenna Employing Self-Complementary Radiating Element and Microstrip Line Feed", Journal of Institute of Electronics, Information and Communication Engineers, (B) vol. J88-B No. 9, Sep. 2005, pp. 1662-1673.

Supplementary Partial European Search Report for EP 07 71 4243 completed Aug. 13, 2009.

* cited by examiner

114

115

116

117

SMALL-SIZE WIDE BAND ANTENNA AND RADIO COMMUNICATION DEVICE

TECHNICAL FIELD

The present invention relates to an antenna using a dielectric substrate and, more particularly, to a small-size antenna for use in wide band radio communication.

BACKGROUND ART

There is known a UWB (Ultra Wide Band) technique for a ultra wide band radio communication. In general, the UWB technique is used in a wireless TV, a wireless LAN system for a notebook PC (notebook personal computer) or portable information terminal (personal digital assistant), and the like. In general, communications using the UWB technique is expected to use a frequency band of 3.1 GHz to 4.9 GHz. To realize the communication using the UWB technique, an antenna compatible with UWB wireless communication is required.

As a conventionally known wide band antenna, there is a discone antenna 200' as shown in FIG. 25. The discone antenna 200' has a structure in which a disk 201' and conical plate 202' serving as a radiating element are fitted, in a manner as illustrated in FIG. 25, to a coaxial cable 203' having a coaxial center conductor 204' covered by a coaxial external conductor 205'.

Further, there is known, in addition to a 3D antenna as the discone antenna 200', a planar antenna having a structure in which a radiating element is formed on a printed board. As an antenna technique of this type, the following Non-Patent Document 1 discloses a wide band antenna using a self-complementary radiating element. This antenna has a structure in which two patterns corresponding to two system-radiating elements of a dipole antenna are formed on a printed board. One of the two patterns is formed on the front surface of the printed board, and the other is formed on the back surface thereof in such a manner as not to face the pattern on the front surface.

Non-Patent Document 1: Journal of Institute of Electronics, Information and Communication Engineers (B) Vol. J88-B No. 9, September 2005, pages 1,662 to 1,673

DISCLOSURE OF THE INVENTION

Problems to be Solved by the Invention

Nowadays, a technique for realizing USB (Universal Serial Bus) connection for a portable information terminal or notebook PC by radio using the above-mentioned UWB technique has been proposed. In general, it is desirable the size of USB devices attached to the portable information terminal or notebook PC be as small as possible, like a memory stick (typically, having a size of length×width×thickness of about 60 mm×15 mm×8 mm), in consideration of the size of the portable information terminal or notebook PC or portability. Therefore, in order to realize the USB connection based on the UWB technique, the size of a radio interface device attached to a terminal is required to be as small as that of the memory stick.

An antenna and a printed board implementing a communication circuit connected to the antenna are mounted on a stick-like USB device according to the UWB technique, that is, radio interface device attached to a terminal. The printed board has a size of length×width of about 50 mm×10 mm. Of the above entire area, a size of length×width of about 20 mm×10 mm is assigned to the antenna.

Although the discone antenna 200 described above can obtain wide band characteristics, it has a 3D shape as shown in FIG. 25 and the size thereof tends to be large and, therefore, is not suitably used as the radio interface device to be attached to the portable information terminal. Although the antenna proposed in Non-patent document 1 has a planar shape, it requires a size of length×width of 65 mm×40 mm. Thus, it is difficult to apply the technique of Non-patent document 1 to the above-mentioned radio interface device in which the size assigned to an antenna is limited to a size of length×width of about 20 mm×10 mm.

The present invention has been made in view of the above problems, and an object thereof is to provide a technique for making an antenna for use in wide band radio communication into a smaller size for mounting on a printed board.

Means for Solving the Problems

A small-size wide band antenna of the present invention includes a radiating element formed on a dielectric substrate and a power supply unit for supplying dipole potential to the radiating element. The radiating element includes a ground potential section having a power supply point to which a ground potential is supplied from the power supply unit and an opposite-pole potential section having a power supply point to which a potential forming a pair with the ground potential is supplied from the power supply unit. Each of the ground potential section and opposite-pole potential section includes a pair of conductors which are formed in a tapered shape on front and rear surfaces of the dielectric substrate and are mutually capacitively coupled. The power supply points of the ground potential section and opposite-pole potential section are positioned at tapered apexes of the conductors formed on the same side (front or rear side) of the dielectric substrate.

The basic concept of the present invention is that each of the two-system radiating elements of a dipole antenna is divided, and the element portions obtained by the division are arranged on the front and rear sides of the dielectric substrate. Thus, two-system radiating elements exist on the same surface of the substrate. When a power is supplied to an antenna having such a configuration, the elements of the same system formed on the front and rear surfaces of the dielectric substrate are capacitively coupled to each other at the portions overlapping each other, i.e., facing each other via the dielectric substrate. As a result, the elements of the same system are electrically connected to each other via the substrate.

Advantages of the Invention

According to the present invention, each of the ground potential section and opposite-pole potential section constituting the radiation element is divided, and conductors serving as the element portions obtained by the division are arranged on the front and rear sides of the dielectric substrate. Thus, the size of the antenna can be reduced. Further, by forming each conductor in a tapered shape, wide band frequency characteristics can be obtained. Therefore, it is possible to apply the present invention to a technique for realizing USB connection by radio using the UWB technique.

EXPLANATION OF REFERENCE SYMBOLS

Figure 1:
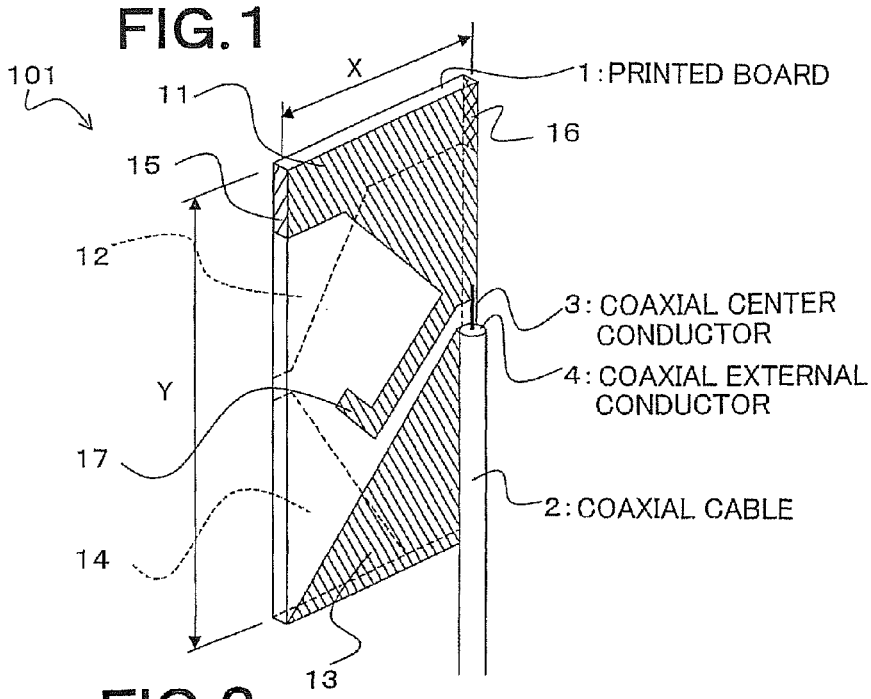
FIG. 1 is a configuration view of a first embodiment of a small-size wide band antenna according to the present invention.

101 to 117: Antenna
1, 61: Printed board (dielectric substrate)
2: Coaxial cable
3: Coaxial center conductor
4: Coaxial external conductor
5: Coaxial external conductor connecting wire
11 to 17, 31, 32, 41, 42: Conductor
21, 51, 73: Through hole
71: Micro-strip line
72: Ground
200: Printed board (dielectric substrate)
201: Ground
202: Micro-strip line
203, 301, 401: Stub
204: Through hole

BEST MODE FOR CARRYING OUT THE INVENTION

Explanation of Configurations of Embodiments—1

Figure 2:
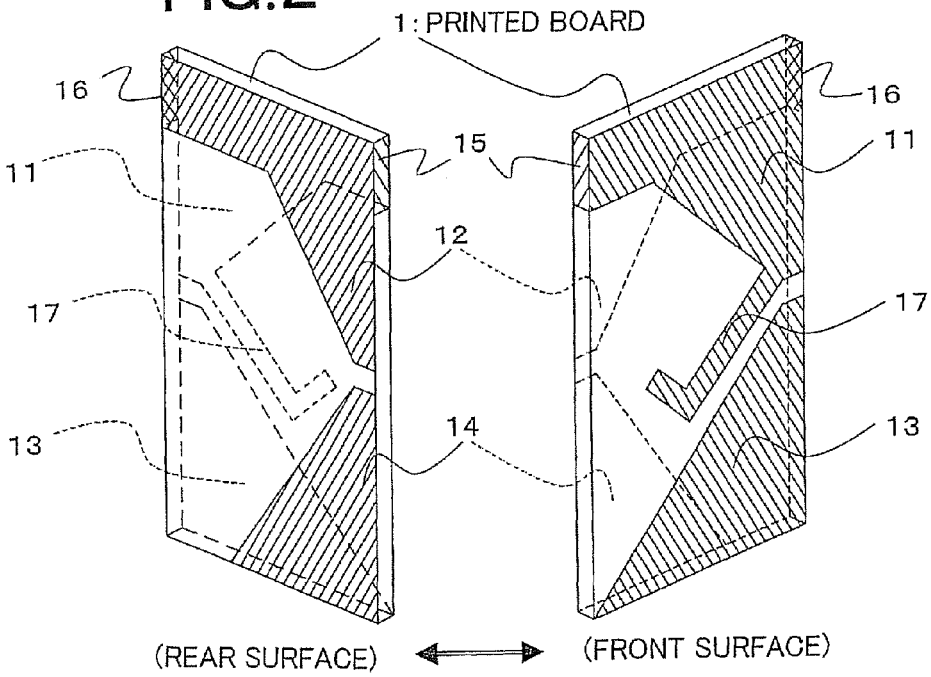
FIG. 2 is a configuration view showing both sides of the antenna according to the first embodiment.

FIG. 1 shows a configuration of an antenna 101 according to a first embodiment of the present invention. FIG. 2 collectively shows conductor patterns formed on the front and rear surfaces of the antenna 101. In the antenna 101 according to the present embodiment, conductors 11 to 16 (to be described later) each serving as a radiating element and a conductor 17 (to be descried later) serving as an impedance matching section are patterned on a printed board 1. The printed board 1 is a rectangular dielectric substrate having a dimension of "Y" in the longitudinal direction and "X" (X<Y) in the traverse direction. That is, the printed board mentioned in the present and subsequent embodiments denotes a dielectric substrate on the outer surface of which the conductors are to be printed.

A coaxial cable 2 serving as a power supply unit for supplying a dipole potential to the radiating elements is connected to the antenna 101. The coaxial cable 2 includes a coaxial external conductor 4 assuming a ground potential and a coaxial center conductor 3 which is covered by the coaxial external conductor 4 and supplies a potential forming a pair with the ground potential to the radiating element.

The printed board 1 has a rectangular shape, and radiating elements are formed in the rectangular antenna area defined by two longitudinal direction peripheral sides (straight peripheral sides each having a dimension of Y) and two traverse direction peripheral sides (straight peripheral sides each having a dimension of X).

The conductor 11 is a tapered conductor pattern which spreads from near the center of a first longitudinal direction peripheral side toward the traverse direction upper peripheral side on the front surface of the printed board 1. The conductor 11 is formed into substantially a right triangle in which one upper apex of the printed board 1 is set as a right-angle apex and has a protruding portion protruding from the hypotenuse of the right triangle toward a second longitudinal direction peripheral side of the printed board 1. The protruding portion is formed into a triangle or trapezoid at near the upper end portion of the printed board 1.

The conductor 12 is a tapered conductor pattern which spreads from near the center of the second longitudinal direction peripheral side toward the traverse direction upper peripheral side on the rear surface of the printed board 1. The conductor 12 is formed into substantially a right triangle in which one upper apex of the printed board 1 is set as a right-angle apex and has a protruding portion protruding from the hypotenuse of the right triangle toward the first longitudinal direction peripheral side of the printed board 1. The protruding portion is formed into a triangle or trapezoid at near the upper end portion of the printed board 1. The conductors 11 and 12 are components corresponding to an opposite-pole potential section to which a potential forming a pair with the ground potential is supplied.

The conductor 13 is a tapered conductor pattern which spreads from near the center of the first longitudinal direction peripheral side toward the traverse direction lower peripheral side on the front surface of the printed board 1. The conductor 14 is a tapered conductor pattern which spreads from near the center of the second longitudinal direction peripheral side toward the traverse direction lower peripheral side on the rear surface of the printed board 1. The conductors 13 and 14 are components corresponding to a ground potential section to which a ground potential is supplied and are formed into substantially right triangles in which different apexes of the printed board 1 are set as right-angle apexes.

The conductors 15 and 16 are formed on both side surfaces corresponding respectively to the second and first longitudinal direction peripheral sides of the printed board 1 and are each connected to both the conductors 11 and 12 to serve as a unit for short-circuiting between the conductors 11 and 12 which are positioned adjacently to the traverse direction upper peripheral side of the printed board 1. The conductor 17 is a hook-like (L-shaped) stub conductor extending from the conductor 11 formed on the front surface of the printed board 1. The bending direction of the conductor 17 is set such that the leading end of the stub conductor faces the conductor 11 (that is, such that the leading end thereof extends substantially in parallel to the diagonal line of the conductor 11). The conductors 15, 16, and 17 are components corresponding to an impedance matching section for matching a characteristic impedance of the coaxial cable 2 and input impedance as viewed from the coaxial cable 2 to conductor 11.

The shape of the conductor 17 serving as a stub is not limited to the hook-like shape as illustrated, but the conductor 17 may be formed into a linear strip shape as long as the leading end thereof is opened. Further, it is not always necessary to arrange the stub at near the tapered apex of the conductor 11, as in the case of the conductor 17, but the arrangement thereof may be changed in accordance with the impedance matching.

Power supply to the antenna 101 having the configuration described above is achieved by soldering the coaxial center conductor 3 of the coaxial cable 2 to the tapered apex of the conductor 11 and further soldering the coaxial external conductor 4 of the coaxial cable 2 uniformly along the first longitudinal direction peripheral side of the printed board 1, starting from the tapered apex of the conductor 13. As a result, the ground potential section and opposite-pole potential section have power supply points, respectively, at tapered apexes of the conductors 11 and 13 formed on the front surface of the dielectric substrate 1.

As described above, the pair of conductors 13 and 14 serving as the ground potential section are arranged such that the areas in the vicinity of the tapered apexes of the respective conductors do not face each other via the dielectric substrate 1 and that the residual areas (areas adjacent to the traverse direction lower peripheral side) of the respective conductors face each other via the dielectric substrate 1. Similarly, the pair of conductors 11 and 12 serving as the opposite-pole potential section are arranged such that the areas in the vicinity of the tapered apexes of the respective conductors do not face each other via the dielectric substrate 1 and that the residual areas (areas adjacent to the traverse direction upper peripheral side) of the respective conductors face each other via the dielectric substrate 1.

The tapered apexes of the conductors 11 and 13 having, respectively, the power supply points of the ground potential section and opposite-pole potential section are positioned near the center of the first longitudinal direction peripheral side of the antenna area having a rectangular shape corresponding to the outer shape of the printed board 1. Respective ones of the sides of the conductors 11 and 13 that form the tapered apexes correspond to the first longitudinal direction peripheral side of the antenna area. The tapered apexes of the conductors 12 and 14 paired respectively with the conductors having, respectively, the power supply points of the ground potential section and opposite-pole potential section are positioned near the center of the second longitudinal direction peripheral side of the antenna area. Respective ones of the sides of the conductors 12 and 14 that form the tapered apexes correspond to the second longitudinal direction peripheral side of the antenna area. Further, respective other ones (i.e., diagonal lines) of the sides of the conductors 13 and 14 serving as the ground potential section that form the tapered apexes cross each other; and respective other ones (i.e., diagonal lines) of the sides of the conductors 11 and 12 serving as the opposite-pole potential section that form the tapered apexes cross each other. Note that the above conductors do not actually cross each other but appear to cross each other when viewed in the normal line direction of the front or rear surface of the substrate.

Figure 3:
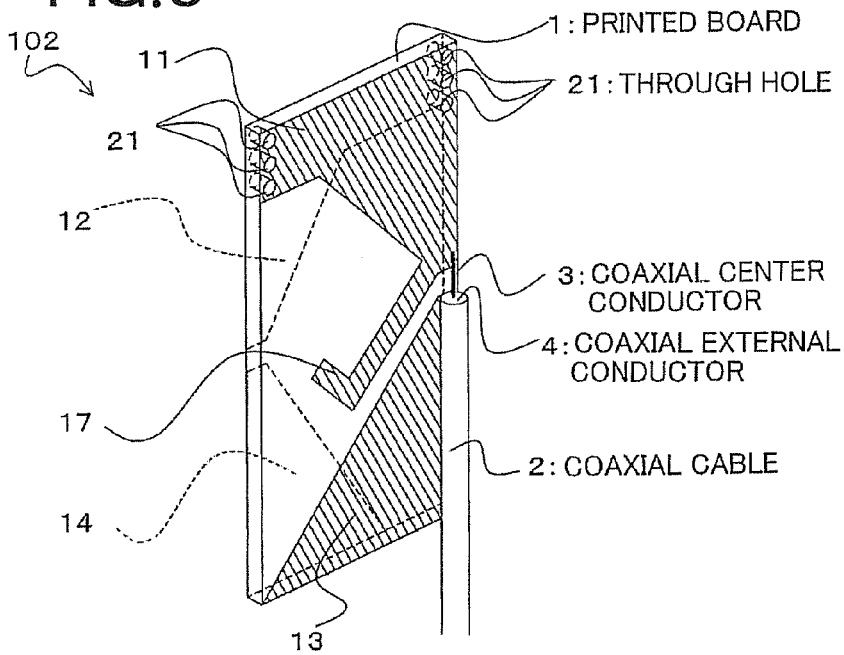
FIG. 3 is a configuration view of a second embodiment of a small-size wide band antenna according to the present invention.
Figure 4:
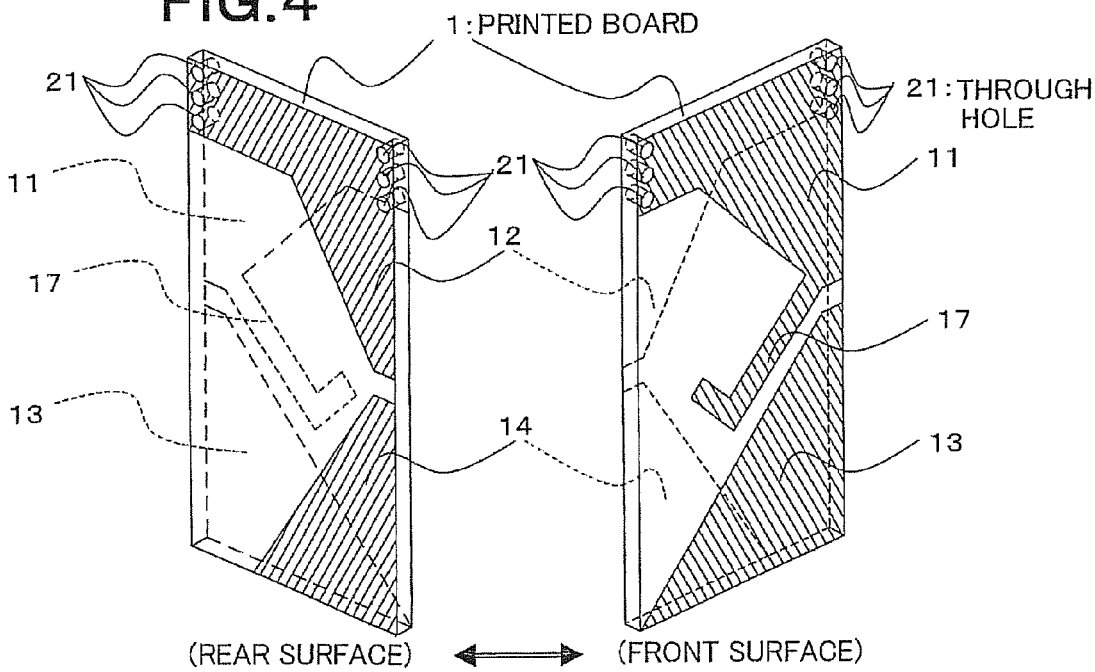
FIG. 4 is a configuration view showing both sides of the antenna according to the second embodiment.

FIG. 3 shows a configuration of an antenna 102 according to a second embodiment of the present invention. FIG. 4 collectively shows conductor patterns formed on the front and rear surfaces of the antenna 102. The antenna 102 of the present embodiment differs from the antenna 101 shown in FIG. 1 in the unit for short-circuiting between the conductors 11 and 12. Concretely, in the antenna 101 of FIG. 1, the conductors 15 and 16 formed on the side surfaces serve as the short-circuit unit, while in the antenna 102 of the present embodiment, through holes 21 shown in FIGS. 3 and 4 serve as the short-circuit unit.

The through holes 21 are known short-circuit unit and also referred to as "via hole". The through holes 21 each have a structure in which a conductor is formed on the inner wall of the hole penetrating the printed board 1 positioned between the conductors 11 and 12. In the example of FIGS. 3 and 4, three through holes 21 are arranged at the upper portion of the printed board 1 along each of the both side surfaces, and thus a total of six through holes are formed. However, the number of the through holes 21 may arbitrarily be determined (e.g., two through holes each and a total of four, or one through hole each and a total of two, or three or more through holes each, etc.) as long as the size of each through hole 21 is sufficiently small enough in terms of high frequency characteristics, i.e., small enough relative to the wavelength used. Further, the arrangement of the through holes 21 is not limited to that shown in FIGS. 3 and 4.

Figure 5:
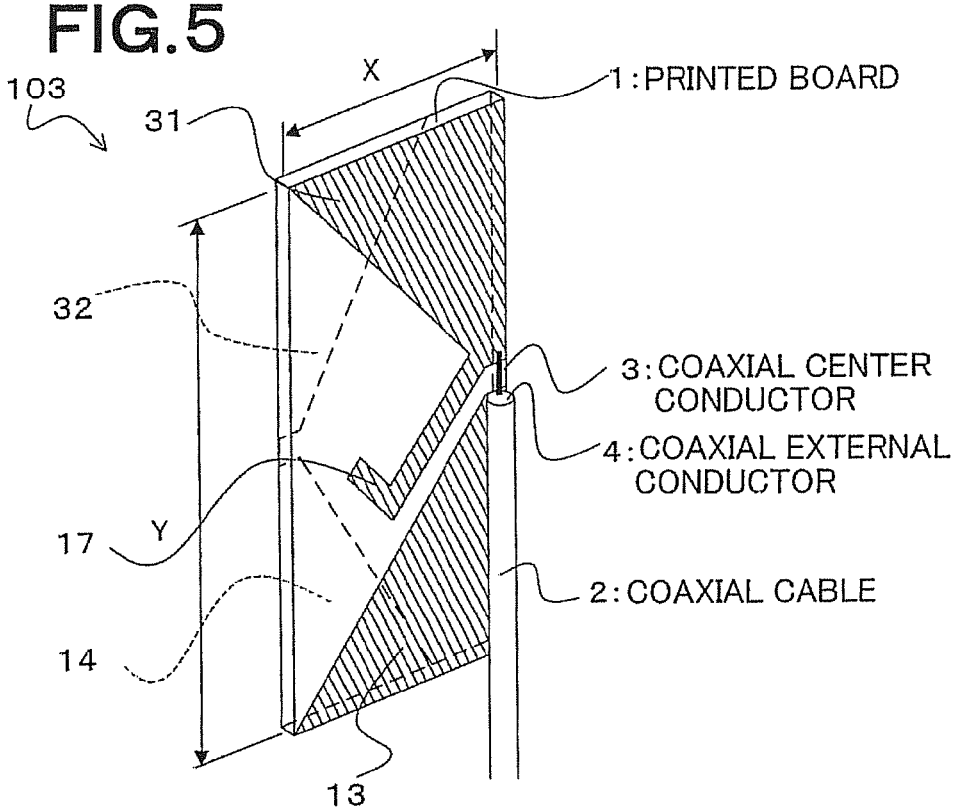
FIG. 5 is a configuration view of a third embodiment of a small-size wide band antenna according to the present invention.
Figure 6:
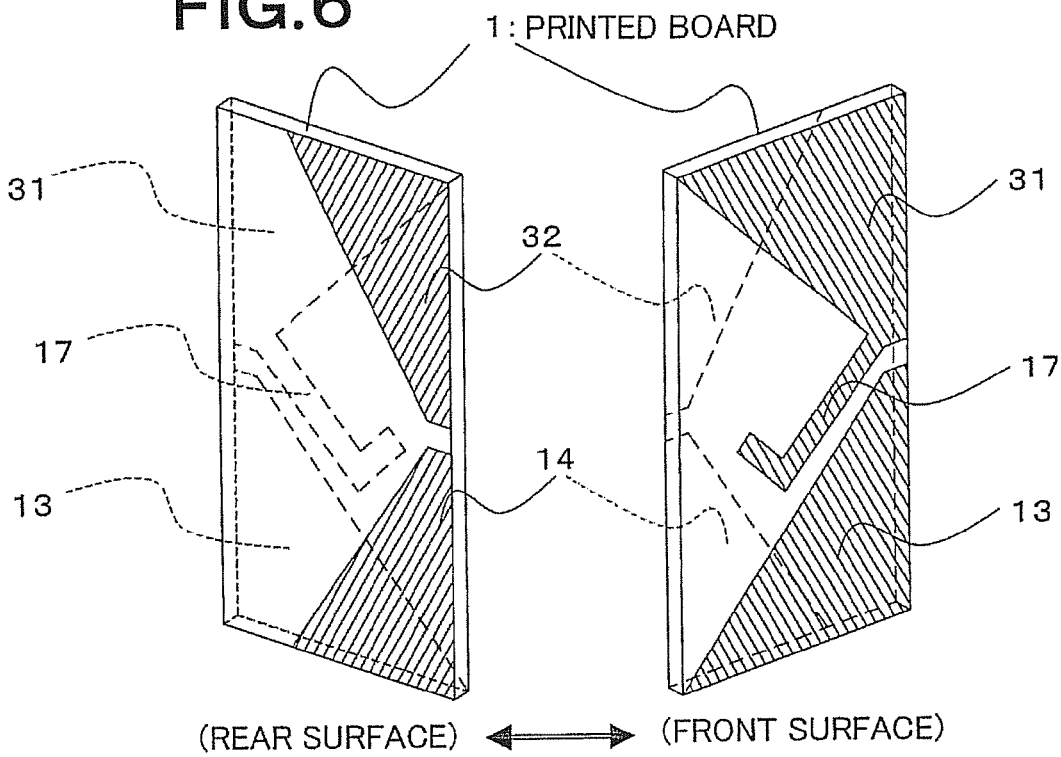
FIG. 6 is a configuration view showing both sides of the antenna according to the third embodiment.

FIG. 5 shows a configuration of an antenna 103 according to a third embodiment of the present invention. FIG. 6 collectively shows conductor patterns formed on the front and rear surfaces of the antenna 103. The antenna 103 of the present embodiment differs from the antenna 101 shown in FIG. 1 in the presence/absence of the short-circuit unit and shape of the conductor pattern serving as the opposite-pole potential section. That is, the antenna 103 does not include the unit for short-circuiting between the conductors on the front and rear surfaces of the printed board 1 and includes conductors 31 and 32 as the opposite-pole potential section in place of the conductors 11 and 12 of FIG. 1.

The conductor 31 is a tapered conductor pattern which spreads from near the center of the first longitudinal direction peripheral side toward the traverse direction upper peripheral side on the front surface of the printed board 1. The conductor 32 is a tapered conductor pattern which spreads from near the center of the second longitudinal direction peripheral side toward the traverse direction upper peripheral side on the rear surface of the printed board 1. As shown in FIGS. 5 and 6, the conductors 31 and 32 are each formed into substantially a right triangle that does not have the protruding portion that the above-mentioned conductors 11 and 12 have.

Figure 7:
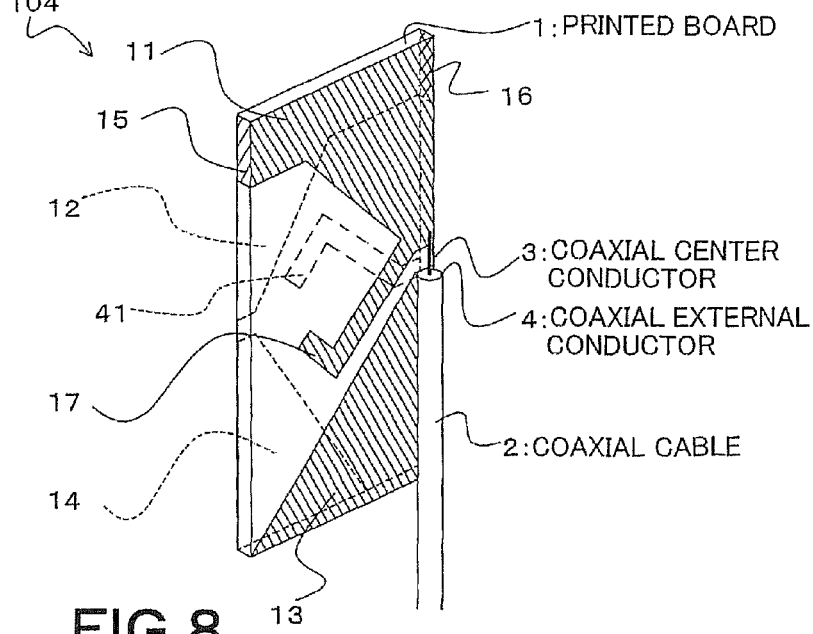
FIG. 7 is a configuration view of a fourth embodiment of a small-size wide band antenna according to the present invention.
Figure 8:
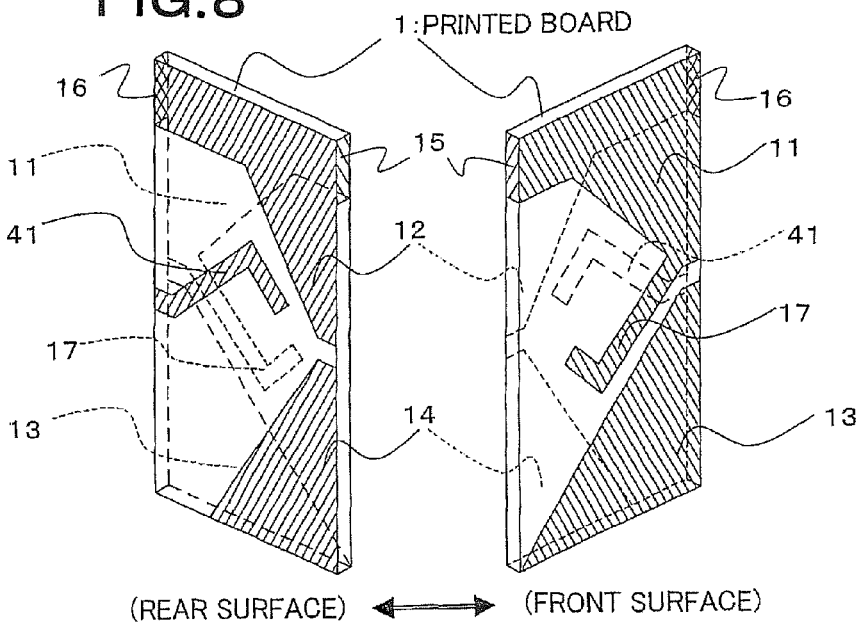
FIG. 8 is a configuration view showing both sides of the antenna according to the fourth embodiment.

FIG. 7 shows a configuration of an antenna 104 according to a fourth embodiment of the present invention. FIG. 8 collectively shows conductor patterns formed on the front and rear surfaces of the antenna 104. The antenna 104 according to the present embodiment has a structure obtained by adding a conductor 41 serving as a stub to the rear surface of the printed board 1 of the antenna 101 of FIG. 1.

The conductor 41 is formed on the rear surface of the printed board 1 such that a part thereof faces the conductor 13 formed on the front surface of the printed board 1 to serve as a second stub conductor constituting the impedance matching section for the ground potential section in the present invention. On the rear side of the printed board 1, the conductor 41 shown in FIGS. 7 and 8 extends from near the center of the first longitudinal direction peripheral side and is formed in an independent manner such that it is not connected to any other conductor patterns. The bending direction of the conductor 41 is symmetrical to the bending direction of the stub conductor 17 formed on the front surface of the printed board 1 with respect to the horizontal direction (direction parallel to the traverse direction peripheral side of the printed board 1). That is, the bending direction of the second stub conductor 41 is set such that the leading end thereof faces (that is, such that the leading end thereof extends in substantially parallel to the diagonal line of the conductor 13), on the front and rear sides of the dielectric substrate 1 (via the dielectric substrate 1), the conductor 13 serving as the ground potential section that is capacitively coupled to the second stub conductor 41. The shape of the conductor 41 is not limited to the hook-like shape (L-shape) as illustrated, but the conductor 41 may be formed into a linear strip shape.

Figure 9:
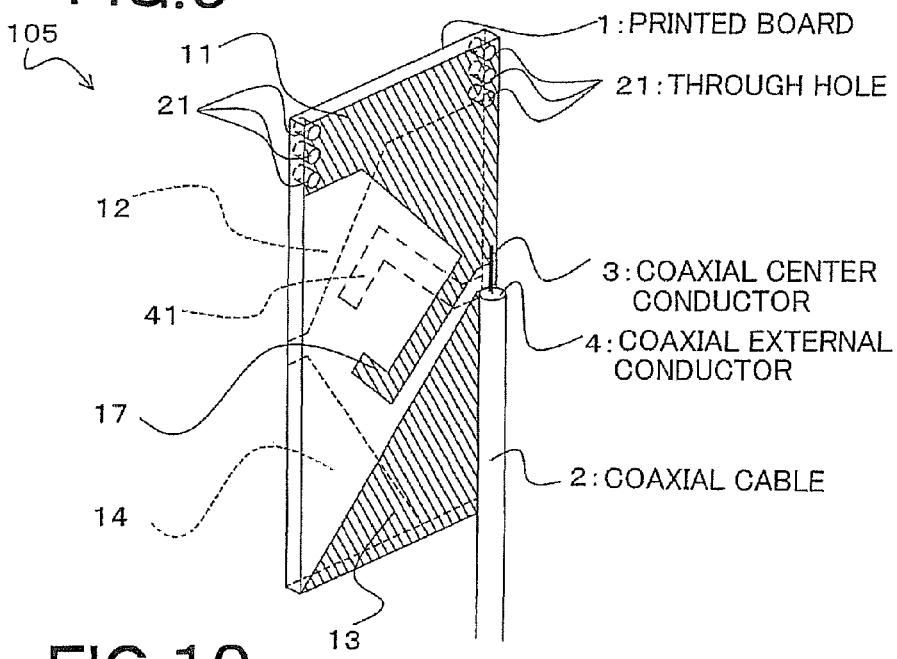
FIG. 9 is a configuration view of a fifth embodiment of a small-size wide band antenna according to the present invention.
Figure 10:
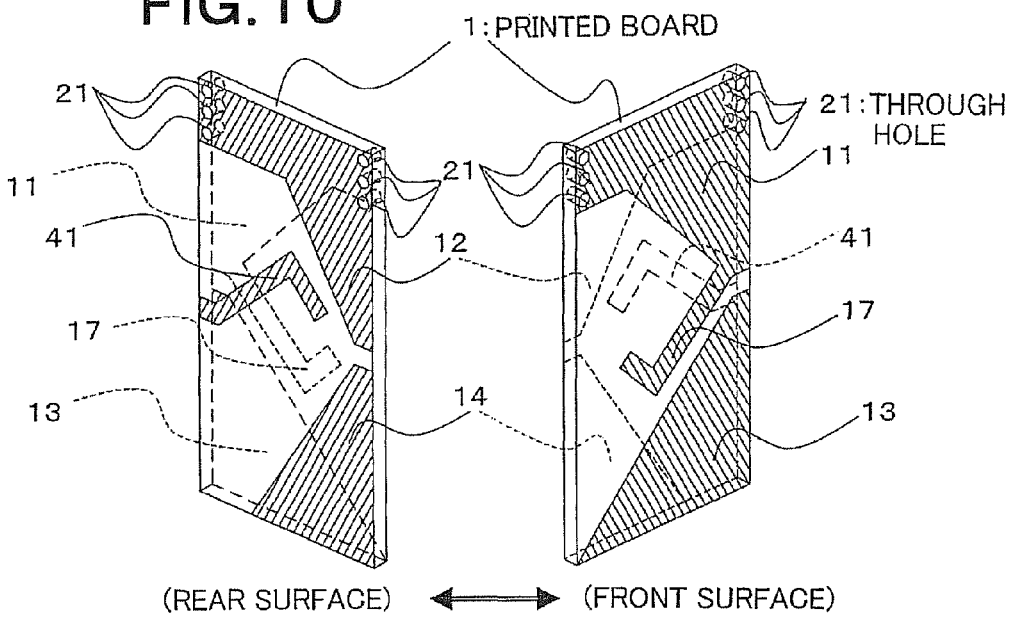
FIG. 10 is a configuration view showing both sides of the antenna according to the fifth embodiment.

FIG. 9 shows a configuration of an antenna 105 according to a fifth embodiment of the present invention. FIG. 10 collectively shows conductor patterns formed on the front and rear surfaces of the antenna 105.

The antenna 105 of the present embodiment differs from the antenna 104 of FIG. 7 in the short-circuit unit. Concretely, in the antenna 104 of FIG. 7, the conductors 15 and 16 formed on the side surfaces of the printed board 1 serve as the short-circuit unit, while as shown in FIG. 9, in the antenna 105 of the present embodiment, through holes 21 serve as the short-circuit unit. The configuration of the through holes 21 is the same as that shown in FIG. 3, and the description thereof is omitted here.

Figure 11:
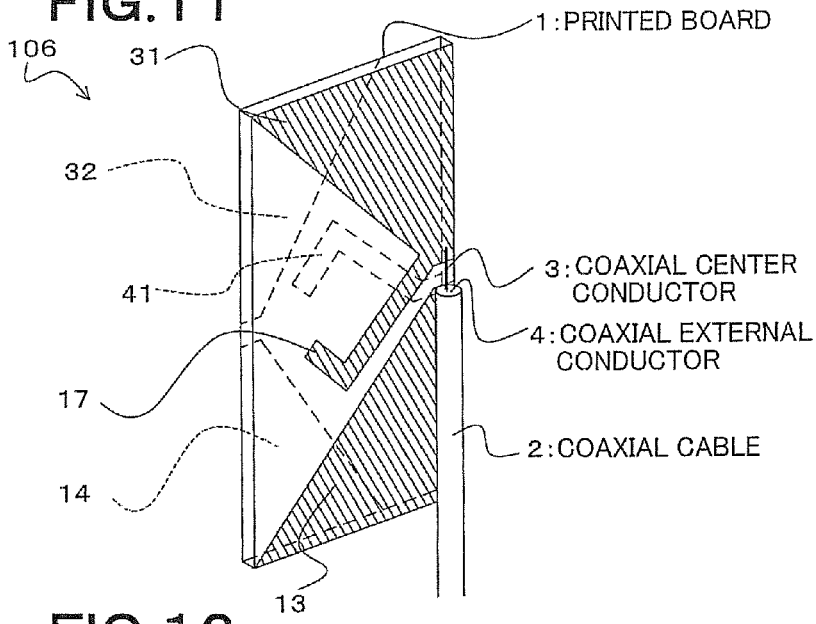
FIG. 11 is a configuration view of a sixth embodiment of a small-size wide band antenna according to the present invention.
Figure 12:
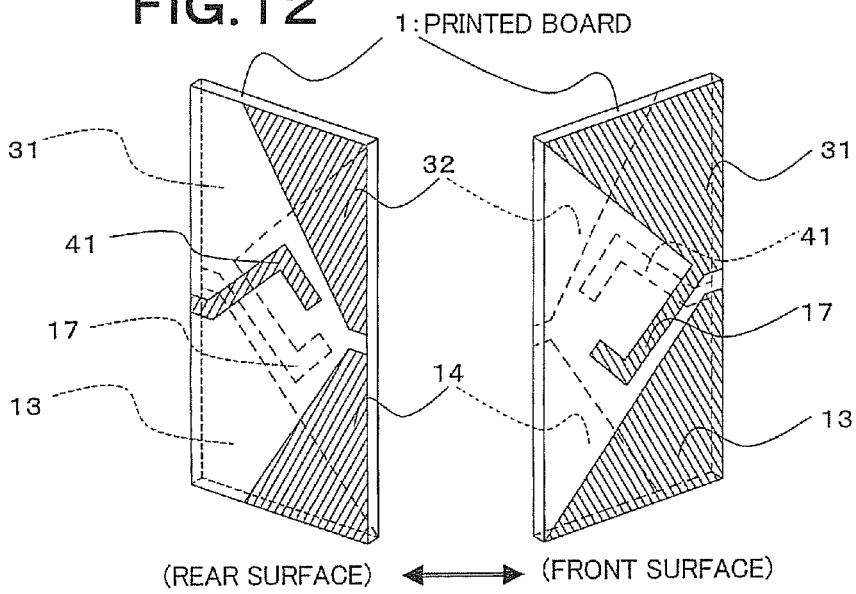
FIG. 12 is a configuration view showing both sides of the antenna according to the sixth embodiment.

FIG. 11 shows a configuration of an antenna 106 according to a sixth embodiment of the present invention. FIG. 12 collectively shows conductor patterns formed on the front and rear surfaces of the antenna 106. The antenna 106 of the present embodiment has a structure obtained by adding the second stub conductor 41 that the antenna 104 of FIG. 7 has to the rear surface of the antenna 103 of FIG. 5 that does not have the short-circuit unit.

Figure 13:
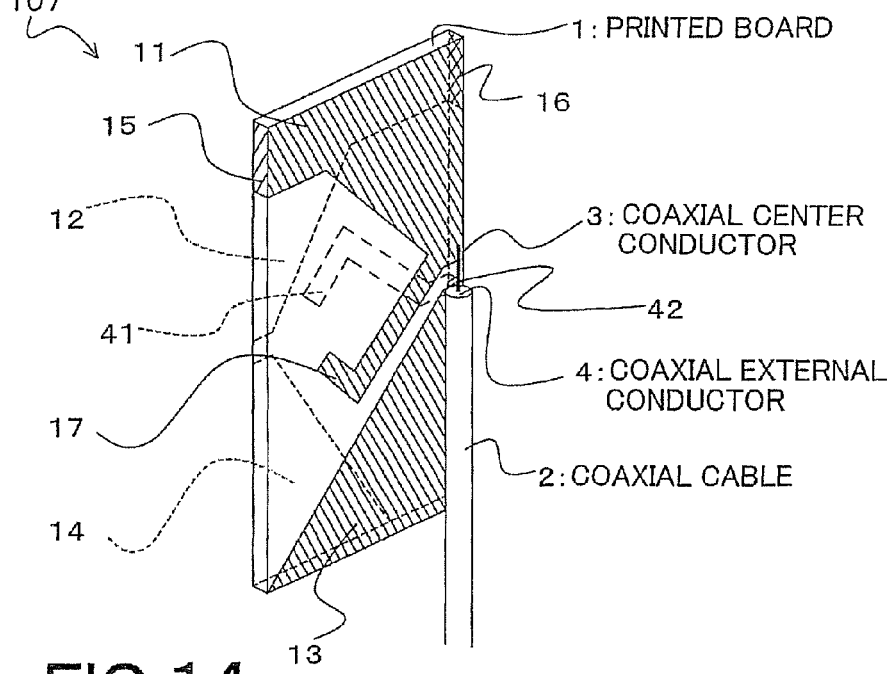
FIG. 13 is a configuration view of a seventh embodiment of a small-size wide band antenna according to the present invention.
Figure 14:
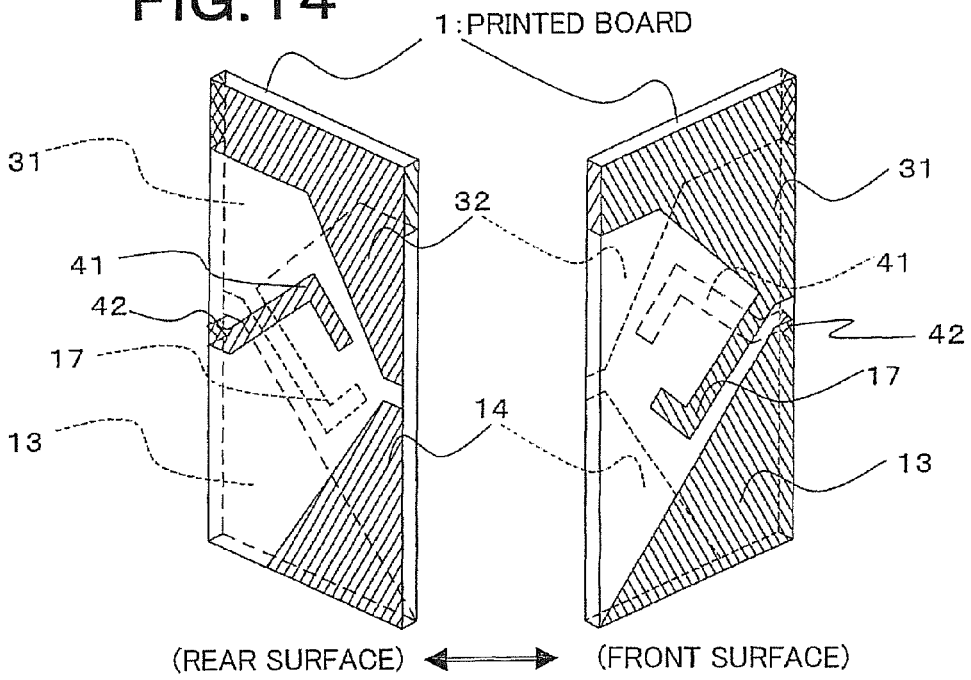
FIG. 14 is a configuration view showing both sides of the antenna according to the seventh embodiment.

FIG. 13 shows a configuration of an antenna 107 according to a seventh embodiment of the present invention. FIG. 14 collectively shows conductor patterns formed on the front and rear surfaces of the antenna 107. The antenna 107 of the present embodiment has a structure obtained by adding a conductor 42 for short-circuiting between the conductor 13 formed on the front surface of the printed board 1 and second stub conductor 41 formed on the rear surface of the printed board 1 at the substrate side surface.

Figure 15:
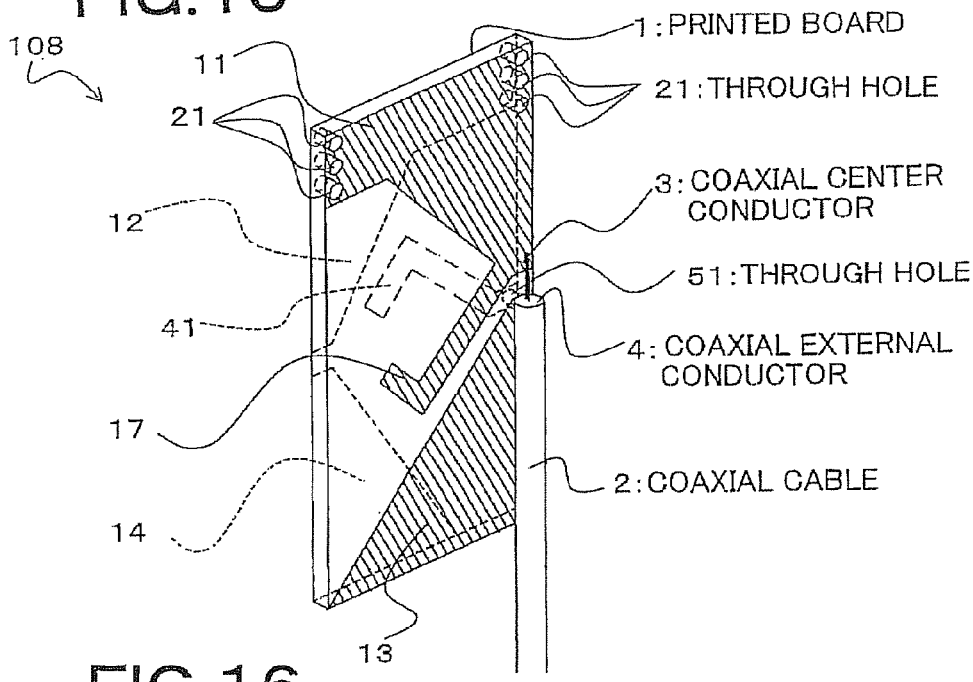
FIG. 15 is a configuration view of an eighth embodiment of a small-size wide band antenna according to the present invention.
Figure 16:
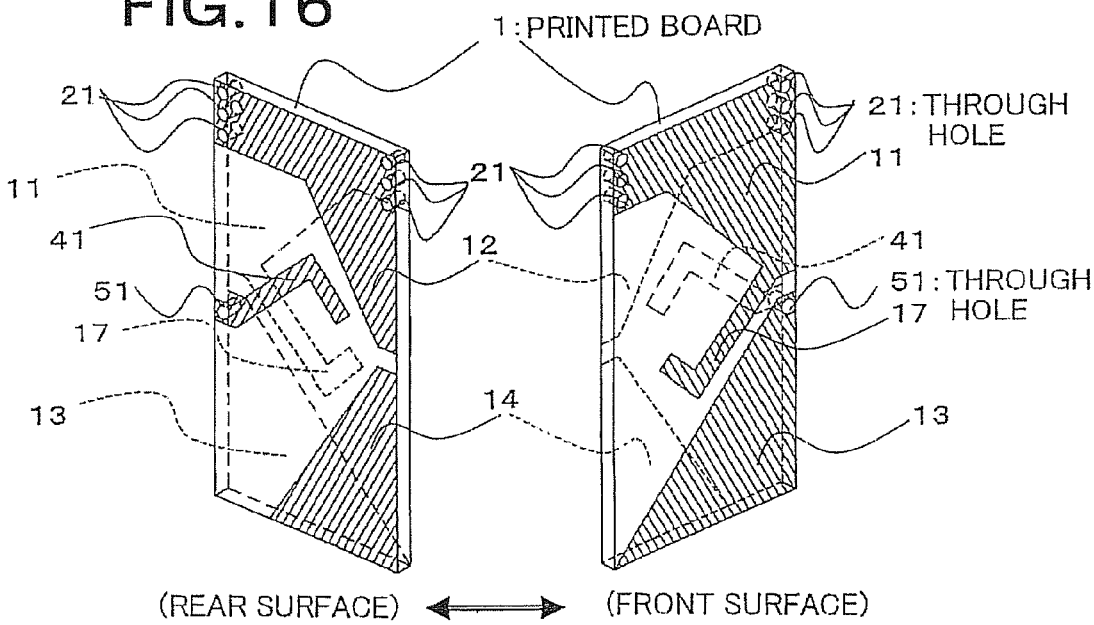
FIG. 16 is a configuration view showing both sides of the antenna according to the eighth embodiment.

FIG. 15 shows a configuration of an antenna 108 according to an eighth embodiment of the present invention. FIG. 16 collectively shows conductor patterns formed on the front and rear surfaces of the antenna 108. The antenna 108 of the present embodiment has a structure obtained by adding a through hole 51 for short-circuiting between the conductor 13 formed on the front surface of the printed board 1 and second stub conductor 41 formed on the rear surface of the printed board 1 to the antenna 105 of FIG. 9. The configuration of the through hole 51 is the same as that of each of the through holes 21 formed at the upper end portion of the printed board 1, and the description thereof is omitted here.

Figure 17:
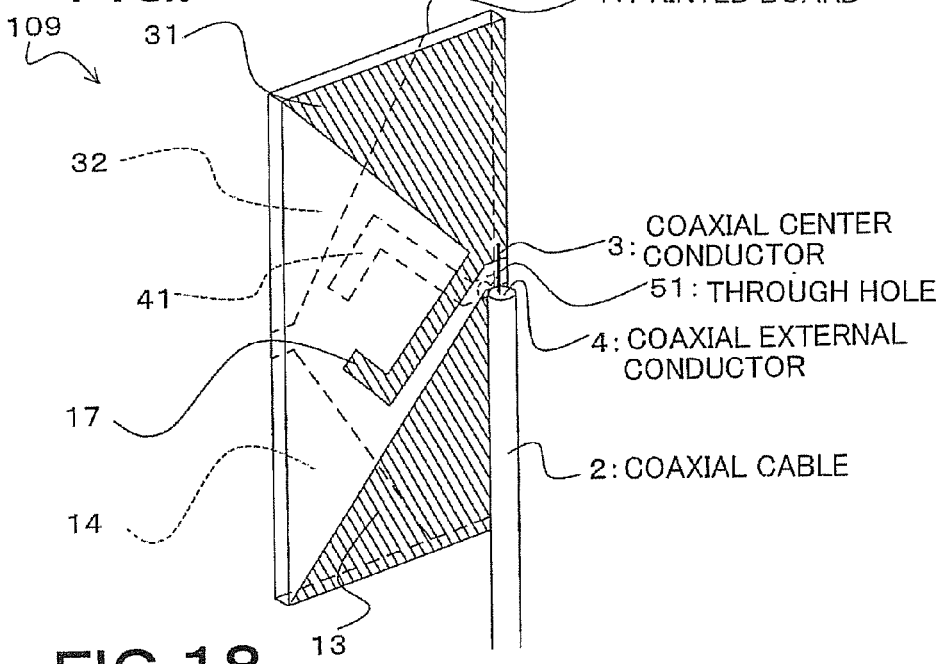
FIG. 17 is a configuration view of a ninth embodiment of a small-size wide band antenna according to the present invention.
Figure 18:
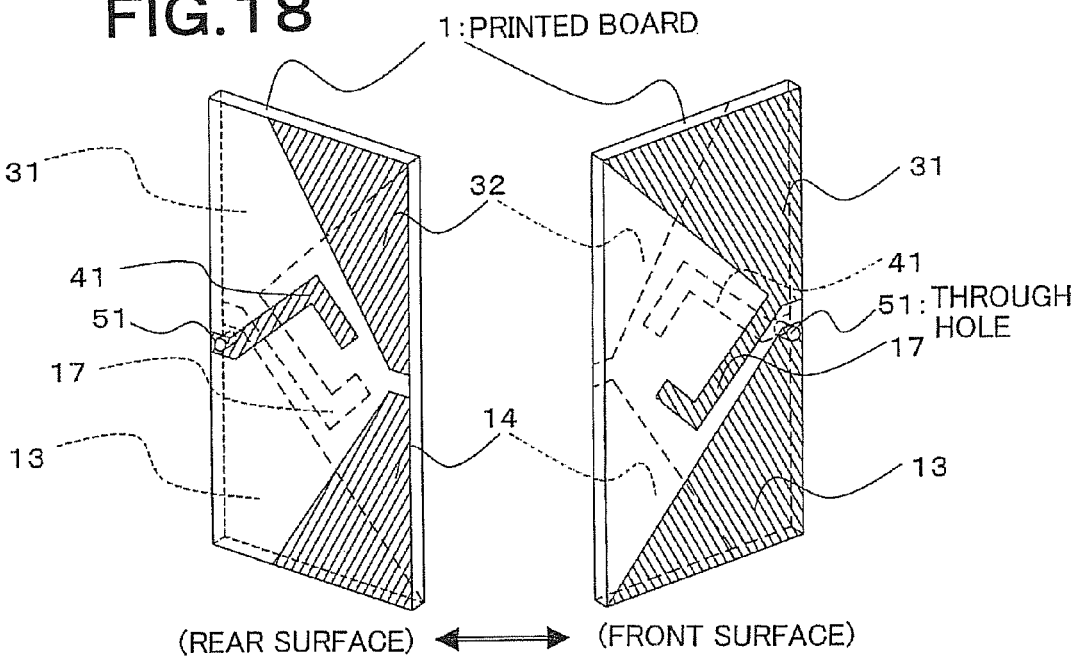
FIG. 18 is a configuration view showing both sides of the antenna according to the ninth embodiment.

FIG. 17 shows a configuration of an antenna 109 according to a ninth embodiment of the present invention. FIG. 18 collectively shows conductor patterns formed on the front and rear surfaces of the antenna 109. The antenna 109 of the present embodiment has a structure obtained by adding the through hole 51 for short-circuiting between the conductor 13 formed on the front surface of the printed board 1 and second stub conductor 41 formed on the rear surface of the printed board 1 to the antenna 106 of FIG. 11.

Figure 19:
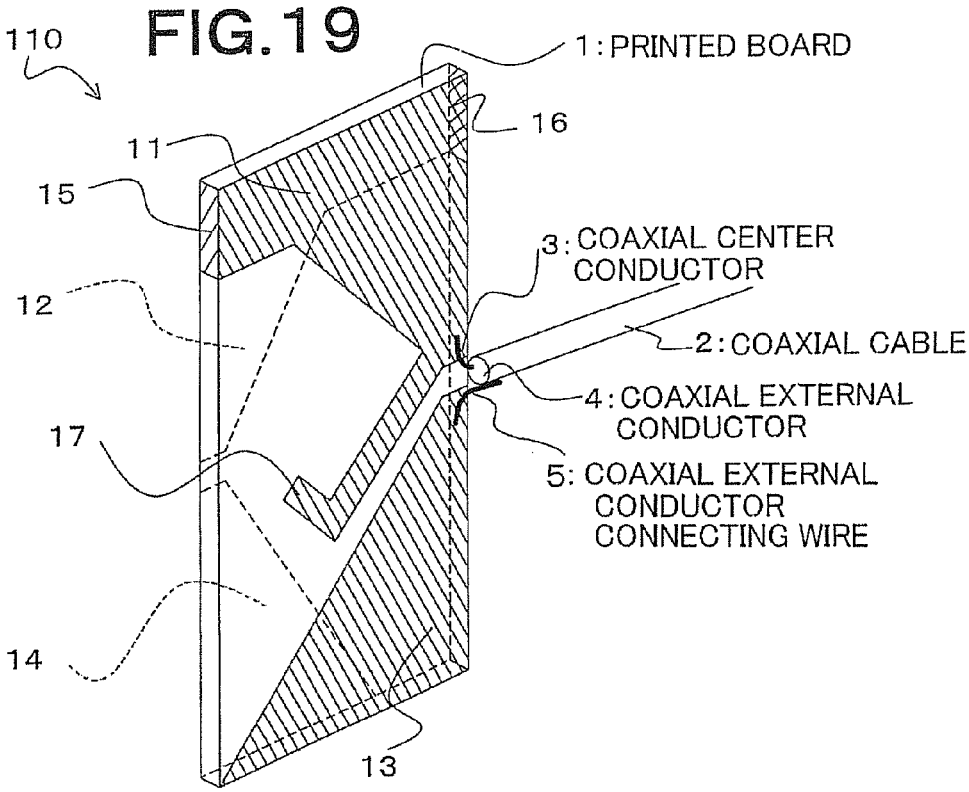
FIG. 19 is a configuration view of a tenth embodiment of a small-size wide band antenna according to the present invention.

Here, two embodiments concerning power supply to the small-size wide band antenna according to the present invention will be described. FIG. 19 shows a configuration of an antenna 110 according to a tenth embodiment of the present invention. Although the conductor pattern of the first embodiment (FIGS. 1 and 2) is applied to the antenna 110 for the sake of convenience, conductor patterns of any other embodiments may be employed.

The power supply method of the antenna 110 is as follows. That is, the coaxial center conductor 3 of the coaxial cable 2 is soldered to the tapered apex of the conductor 11, and the coaxial external conductor 4 is connected to the tapered apex of the conductor 13 by a coaxial external conductor connecting wire 5. More specifically, one end of the coaxial external conductor connecting wire 5 is soldered to the coaxial external conductor 4, and the other end thereof is soldered to the tapered apex of the conductor 13.

In the above-described first to ninth embodiments, the coaxial cable 2 is arranged along the longitudinal direction of the printed board 1 for connection, while in the present embodiment shown in FIG. 19, the coaxial center conductor 3 is bent such that the coaxial cable 2 is arranged in the direction substantially perpendicular to the longitudinal direction of the printed board 1.

Figure 20:
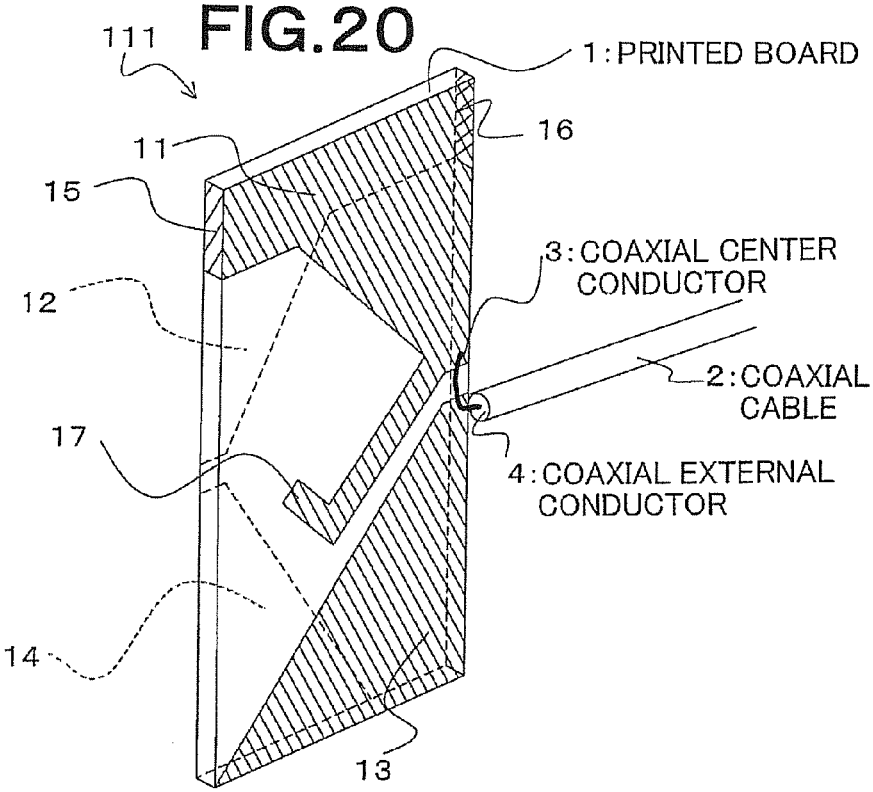
FIG. 20 is a configuration view of an eleventh embodiment of a small-size wide band antenna according to the present invention.

FIG. 20 shows an eleventh embodiment of the present invention as another embodiment concerning the power supply method. An antenna 111 of the present embodiment differs from the antenna 110 of FIG. 19 in the connection configuration of the coaxial external conductor 4. That is, in the antenna 110 of FIG. 19, the conductors 13 and coaxial external conductor 4 are connected to each other by the coaxial external conductor connecting wire 5, while, in the antenna 111 of the present embodiment, the coaxial external conductor 4 is directly soldered to the tapered apex of the conductor 13 in a point contact manner.

As described above, in practicing the present invention, any one of the power supply methods as shown in FIGS. 1, 19, and 20 can be selected in accordance with the wiring direction of the coaxial cable 2.

Figure 21:
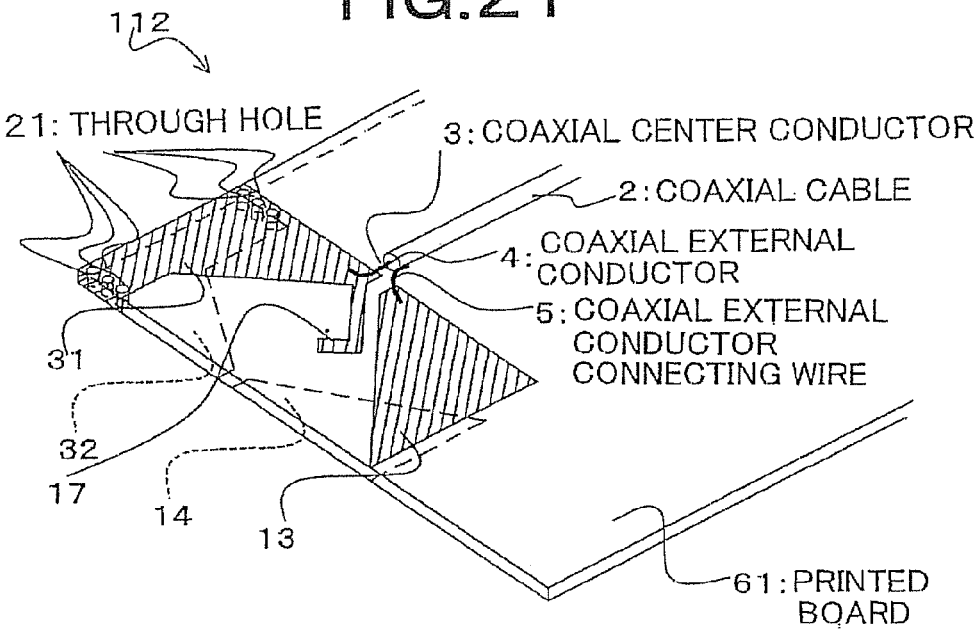
FIG. 21 is a configuration view of a twelfth embodiment of a small-size wide band antenna according to the present invention.

FIG. 21 shows a configuration of a twelfth embodiment of the present invention. In the above-mentioned embodiments, the dimension of the printed board 1 defines the outer peripheral dimension of the antenna, while in the present embodiment, an antenna 112 is formed on an area (antenna area) of a printed board 61 having a size larger than that of the printed board 1. The printed board 61 is a dielectric substrate mounted in a radio communication device such as a USB compatible radio interface device attached to a portable information terminal. This printed board 61 is used to form a not shown communication circuit together with the antenna 112.

That is, the dielectric substrate 61 has a rectangular shape, and the radiating elements are formed in the rectangular antenna area defined by a part of the longitudinal direction peripheral side of the dielectric substrate 61 and a part of the traverse direction peripheral side thereof. The longitudinal direction of the dielectric substrate 61 need not coincide with the longitudinal direction of the antenna area and, for example, they may be perpendicular to each other.

Figure 31:
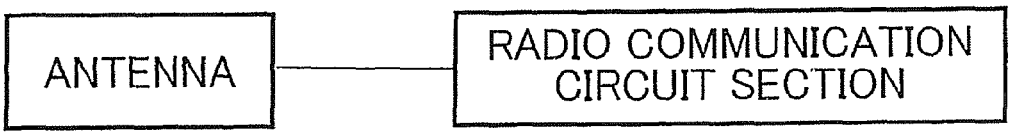
FIG. 31 is a block diagram schematically showing a radio communication device.

A radio communication device including a small-size wide band antenna and a radio communication circuit section which is formed using the printed board 61 on which the antenna is formed and electrically connected to the antenna is thus obtained. A block diagram schematically showing a configuration of such a radio communication device is shown in FIG. 31.

The antenna 112 shown in FIG. 21 adopts the conductor pattern of the antenna 102 shown in FIG. 3 and power supply method shown in FIG. 19. Any of the conductor patterns in the previously-described embodiments may be applied to the antenna to be formed on the printed board 61. However, in the case where the short-circuit unit is provided, the conductor pattern having the through holes is preferably employed.

Figure 22:
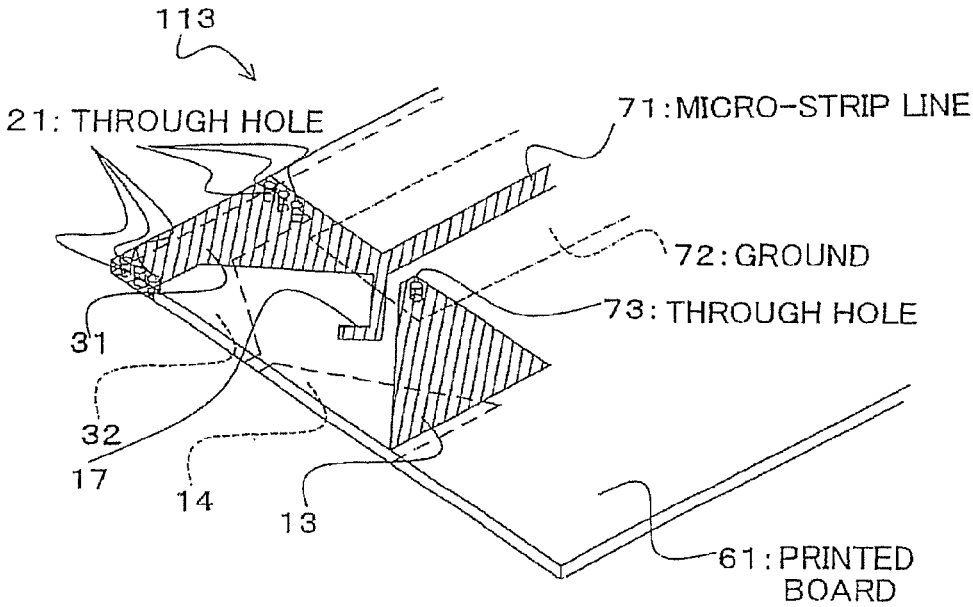
FIG. 22 is a configuration view of a thirteenth embodiment of a small-size wide band antenna according to the present invention.
Figure 23:
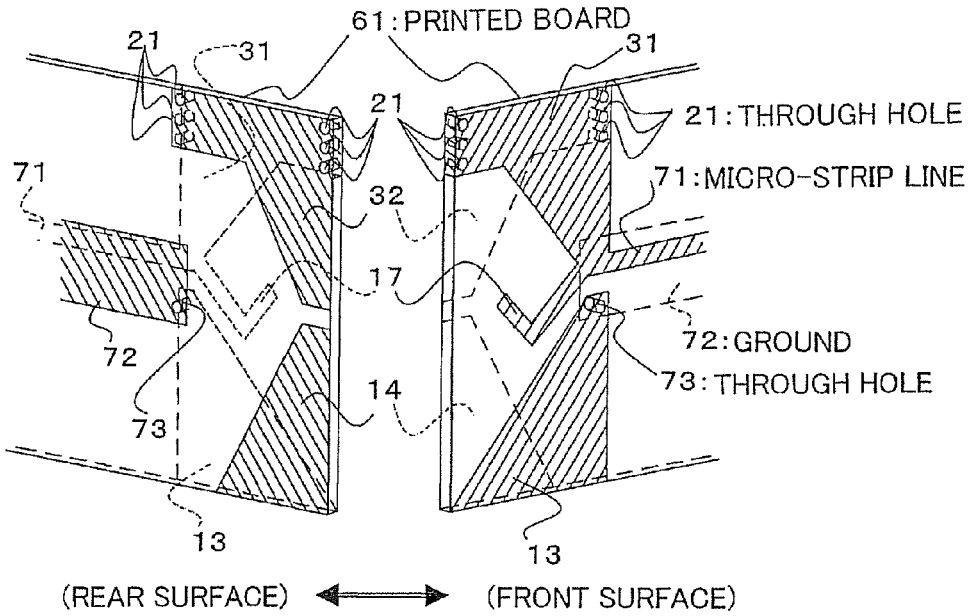
FIG. 23 is a configuration view showing both sides of the antenna according to the thirteenth embodiment.

FIG. 22 shows a configuration of a thirteenth embodiment of the present invention. FIG. 23 collectively shows conductor patterns formed on the front and rear surfaces of an antenna 113 according to the present embodiment.

The antenna 113 of the present embodiment has a structure obtained by forming, as the power supply unit, a micro-strip line 71 and a ground 72 on the front and rear surfaces of the printed board 1, respectively, in place of the configuration of the antenna 112 of FIG. 21 in which the coaxial cable 2 is connected as the power supply unit. Concretely, as shown in FIG. 22, the micro-strip line 71 corresponding to the coaxial center conductor 3 is connected to the conductor 31 formed on the front surface of the printed board 1, and short-circuit between the ground 72 which corresponds to the coaxial external conductor 4 and is formed on the rear surface of the printed board 1 and conductor 13 formed on the front surface of the printed board 1 is made by the use of the through holes 73.

The short-circuit configuration between the conductor 13 formed on the front surface and ground 72 formed on the rear surface is not limited to that shown in FIGS. 22 and 23. For example, the short-circuit between the conductor 13 and ground 72 may be achieved by soldering connection using a bar-like conductor or conducting wire. Alternatively, a configuration in which high frequency short-circuit between the conductor 13 and ground 72 is achieved by an electrostatic capacitance by forming a pattern of the ground 72 extended to below the conductor 13 may be employed.

Although, in the above embodiments, the conductors 15 and 16 (e.g., FIG. 1) formed on the side surfaces of the printed board 1 are used as the short-circuit unit, a configuration may be employed in which conductors for short-circuiting between the conductors 11 and 12 are formed on the upper end surface of the printed board 1, i.e., on the traverse direction upper peripheral side of the circuit board 1. In this case, as a conductor pattern, the conductors 31 and 32 as shown in FIG. 5 may be used in place of the conductors 11 and 12 (FIG. 1) having the rectangular part or protruding portion at the upper end portion of the printed board 1.

Further, with regard to the small-size wide band antenna according to the present invention, the shape of the radiating element is not limited to that shown in the above embodiments. For example, each conductor pattern serving as the radiating element may be formed into substantially a triangle having no right angle. Further, each conductor pattern may be formed into not only a shape defined only by straight lines but also a shape including curved lines as long as it has a tapered shape including the apex at which the power supply point is set. Further, a configuration may be employed in which both of the two sides forming the tapered apex of each of the conductors serving as the ground potential section and opposite-pole potential section do not coincide with the peripheral side of the printed board.

<Explanation of Electrical Action—1>

Next, electrical action of the small-size wide band antenna according to the present invention will be described. A description will first be made by taking up the antenna 103 of FIG. 5 that does not have the short-circuit unit as an example. The basic operation of the antenna 103 is based on a dipole antenna. In FIG. 5, the coaxial cable 2 is connected to the conductors 31 and 13 on the front surface of the printed board 1. That is, each of the conductors 31 and 13 corresponds to a dipole element of the dipole antenna.

However, merely forming the conductors 31 and 13 on the front surface of the substrate is not enough to ensure absolute length as the element. Thus, the conductors 32 and 14 are formed in order to make up for the deficiency. That is, the opposite-pole potential section according to the present invention is formed using the front surface conductor 31 and rear surface conductor 32, and ground potential section according to the present invention is formed using the front surface conductor 13 and rear surface conductor 14.

Although the front surface conductor 31 and rear surface conductor 32 constituting the opposite-pole potential section are not galvanically brought into conduction, they can be regarded as being connected in a high frequency manner to each other. The connection in a high frequency manner denotes an action induced by capacitive coupling between the conductors 31 and 32. More specifically, when a power is supplied from the coaxial cable 2, the capacitive coupling occurs at the overlapping portion between the conductors 31 and 32 via the printed board 1, whereby electrical connection between the conductors 31 and 32 is established.

Therefore, when viewing the antenna 103 as the dipole antenna, it is possible to regard the length of the radiating element connected to the coaxial center conductor 3 as one obtained by adding the lengths of the conductors 31 and 32, and to consider that the conductors 31 and 32 are connected to each other at the upper end portion of the printed board 1 and the conductor 32 is folded to the rear side.

Since both the conductors 31 and 32 are formed into a tapered shape, when assuming a state where they are connected to each other on the same plane, the obtained shape is like a parallelogram. Thus, it is possible to ensure routes of various lengths as a propagation route of electricity from the tapered apex of the conductor 31 serving as the power supply point to conductor 32. This means that various wavelengths can be distributed, that is, wide band characteristics can be obtained.

The electrical action in the ground potential section which is another element of the dipole antenna is the same as that obtained in the case where the above description is applied to the conductors 13 and 14, and the description thereof is omitted here. The conductor 17 is, as described above, a stub which is formed at an appropriate position for achieving impedance matching.

Next, the electrical action of the present invention will be described by taking up the antenna 101 of FIG. 1 that has the short-circuit unit as an example. The electrical action in the antenna 101 of FIG. 1 is basically the same as that in the antenna 103 of FIG. 5. A difference between the antennas 101 and 103 is the presence/absence of the short-circuit unit for achieving impedance matching. That is, in the antenna 101, the conductors 11 and 12 serving as the opposite-pole potential section each have the protruding portion, and the conductors 11 and 12 are short-circuited by the conductors 15 and 16 connected to the protruding portions.

Although there is such a structural difference between the antenna 101 of FIG. 1 and antenna 103 of FIG. 5, they have the same configuration in that respective antenna elements are formed in a folded manner at the end portion of the printed board 1 and they are capacitively coupled through the overlapping portions obtained by the folding. It is convenient to think that the structural difference between the antennas 101 and 103 exists in the impedance matching unit, and it can be concluded that there is no difference, in principle, in the electrical action between them.

As described above, any of the small-size wide band antennas according to the present invention operate in the same manner in principle as the dipole antenna having dipole elements.

The actual dimension of the small-size wide band antenna according to the present invention will be described. The antenna dimension can be calculated using a minimum wavelength of the use frequency. For example, the traverse direction dimension of the antenna can be set to about 0.1 wavelengths, and the longitudinal direction dimension thereof can be set to about 0.2 wavelengths. In the example of FIGS. 1 and 5, X is set to about 0.1 wavelengths, and Y is set to about 0.2 wavelengths.

As described above, the antenna according to the present invention can be regarded as a structure in which each element of the dipole antenna having a wide center portion is folded. Thus, since the longitudinal length (Y) in the folded state is 0.2 wavelengths, the length of each element becomes 0.2 wavelengths in the extended state. Further, when considering the diagonal direction of the element, that is, considering that a current also flows in the diagonal line direction in the above-mentioned pseudo parallelogram, it can be considered that the entire length of each element is about 0.25 wavelengths. In view of this, it can be understood that the principle of the present invention is sufficiently practical and effective for the wide band communication.

In the case where the minimum value of the use frequency is, e.g., 3.1 GHz, the wavelength corresponding to the frequency is about 9.7 mm. In this case, it can be understood that when the size of 10 mm× about 20 mm can be ensured as the antenna dimension, the present invention can be practiced. Thus, the present invention can suitably be applied to a radio interface device for realizing USB connection based on the UWB technique.

Figure 24:
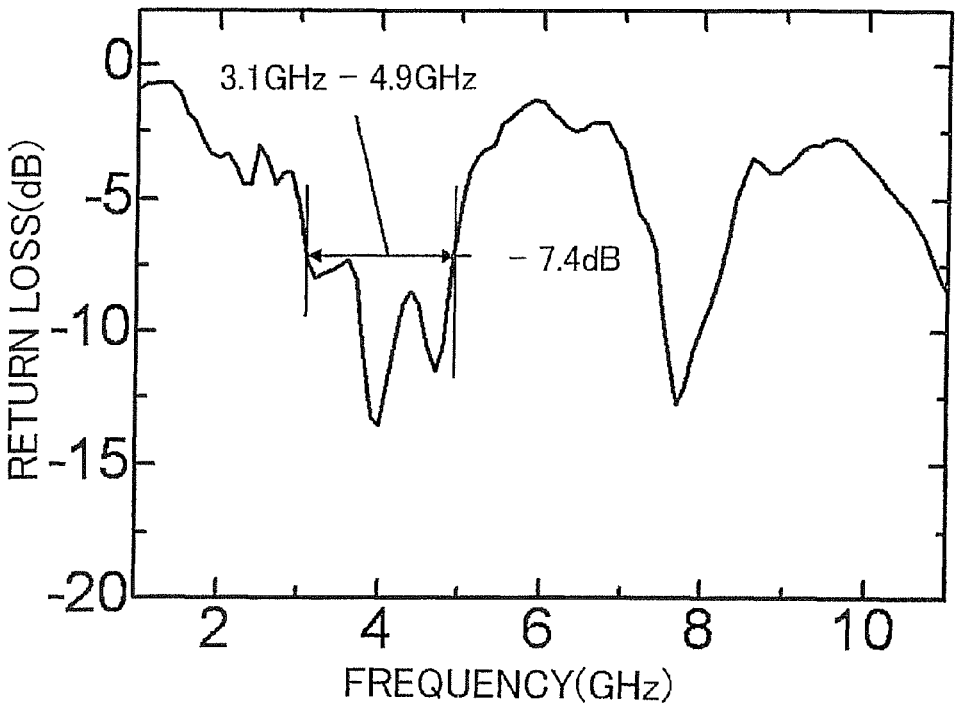
FIG. 24 is an explanatory view of return loss characteristics of the small-size wide band antenna according to the present invention.
Figure 25:
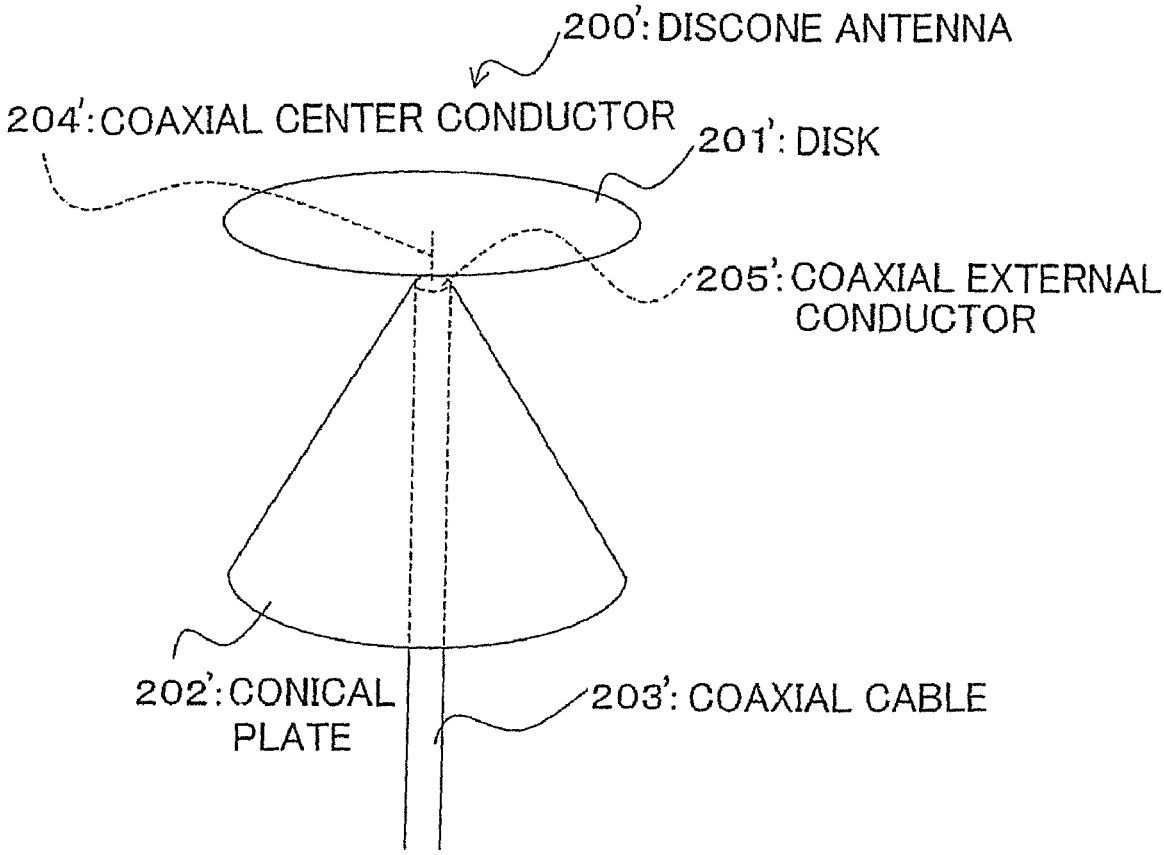
FIG. 25 is a configuration view of a conventional discone antenna.

FIG. 24 shows the actual measurement value of return loss characteristics in the configuration of FIG. 1. It is assumed that the printed board 1 shown in FIG. 1 has a dimension of length (Y)×width (X)×thickness of about 20 mm×10 mm×0.8 mm. The material of the printed board 1 is an FR-4 substrate (glass-epoxy substrate). As shown in FIG. 24, the return loss between 3.1 GHz and 4.9 GHz is about −7.4 dB, and VSWR obtained is 2.5 or less.

According to the embodiments described above, it is possible to form a small-size antenna capable of meeting the requirement of wide band radio communication such as the UWB on the printed board.

Explanation of Configurations of Embodiments—2

Figure 26:
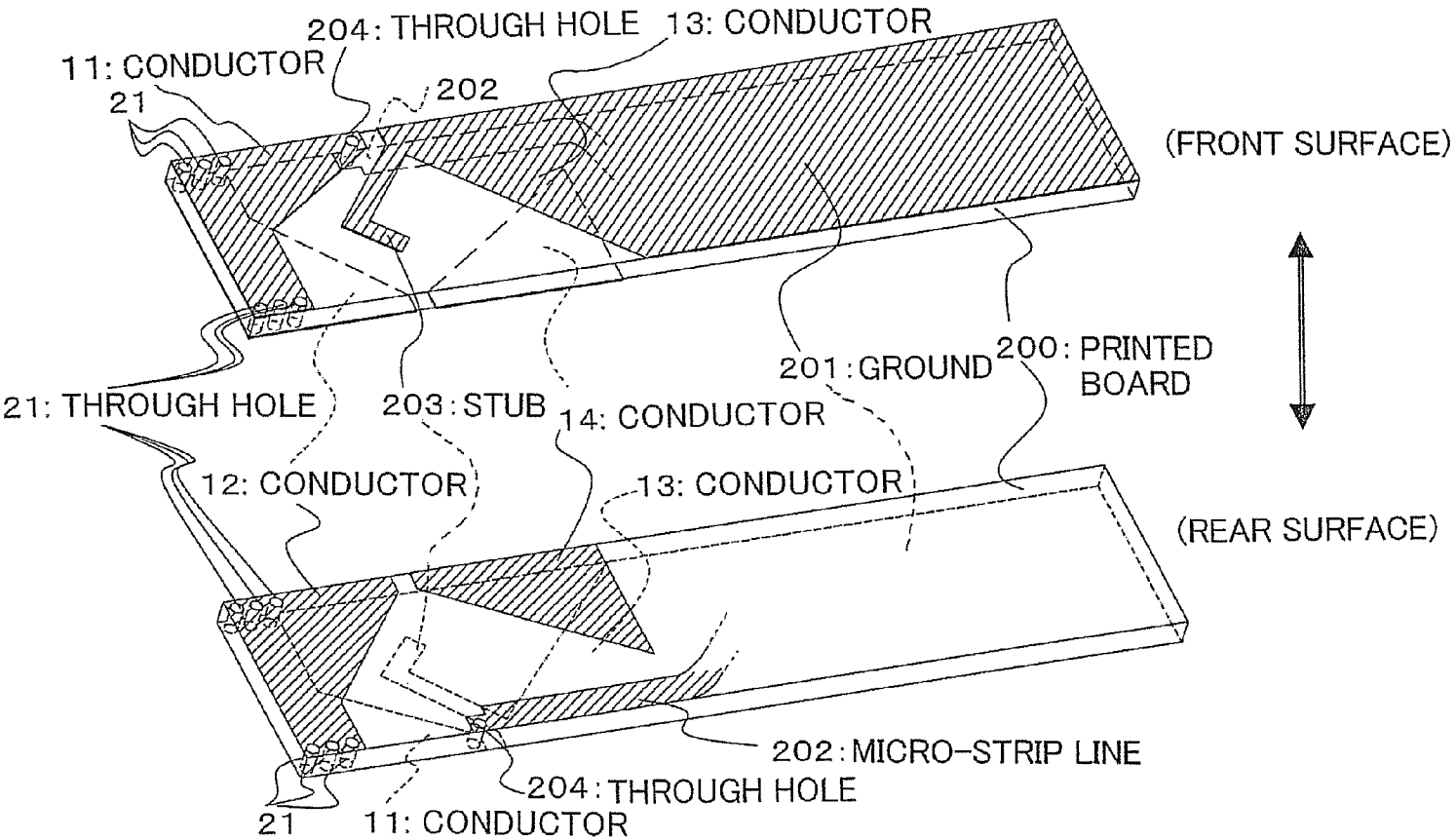
FIG. 26 is a configuration view showing both sides of the antenna according to a fourteenth embodiment.

FIG. 26 shows a configuration of a fourteenth embodiment of the present invention. FIG. 26 collectively shows conductor patterns formed on the front and rear surfaces of an antenna 114 according to the present embodiment. The antenna 114 of the present embodiment is based on the antenna 113 (FIGS. 22 and 23) having the micro-strip lines (71 and 72) as the power supply unit.

The antenna 114 includes a printed board 200, in which the entire shape or at least the shape of the antenna area is formed into a rectangle, conductors 11, 12, 13 and 14 formed on the front and rear surfaces of the printed board 200 at its one end portion, and a micro-strip line 202 and a ground 201 which serve as the power supply unit. The micro-strip line 202 corresponds to a first conductor constituting a micro-strip line in the present invention, and the ground 201 corresponds to a second conductor thereof.

The shapes of the conductors 11 to 14 are basically the same as corresponding conductors shown in the above embodiments. However, the conductor 13 is connected to the ground 201 at its gradually-widening end portion and is substantially integrated with the ground 201. The ground 201 is so-called a ground plate that is formed on the printed board 200 so as to supply components such as an LSI (not shown) for UWB implemented on the printed board 200 with a ground potential. In the present embodiment, the conductor 13 and ground 201 are integrated with each other so that the ground 201 is shared by the antenna 114 and implemented components.

As shown in FIG. 26, the antenna 114 has a stub 203 which is a hook-like stub conductor extending from the tapered apex of the conductor 13 formed on the front surface of the printed board 200. The bending direction of the stub 203 is set such that the leading end of the stub faces the conductor 13 (that is, such that the leading end thereof extends in substantially parallel to the diagonal line of the conductor 13). The stub 203 is provided for adjusting electrical impedance of the antenna 114, so that the arrangement and number of the stubs are not limited to those illustrated, but may be changed as needed.

The power supply to the antenna 114 is made by the micro-strip line 202 connected to the tapered apex of the conductor 11 via the though hole 204. If needed, one end of the micro-strip line 202 is connected to a circuit such as the LSI for UWB implemented on the ground 201 side.

A radio communication device including a small-size wide band antenna and a radio communication circuit section which is formed using the printed board 200 on which the antenna is formed and electrically connected to the antenna is thus obtained.

<Explanation of Electrical Action—2>

The electrical action in the antenna 114 is the same in principle as that described with the antennas 101 and 103 (FIGS. 1 and 5) taken as examples. Quoting the above description, the antenna 114 can be regarded as a vertical dipole antenna. Further, the conductor 13 and ground 201 are integrated with each other in the antenna 114, so that the right end (in FIG. 26) of the conductor 13 partially actions as a part of the other element of the dipole, as described in the explanation of the electrical action about the antenna of FIG. 5. Thus, by connecting the conductor 13 to the ground 201 so as to allow a current on the conductor 13 to freely flow into the ground 201 side, the effect of impedance matching can be enhanced.

Figure 27:
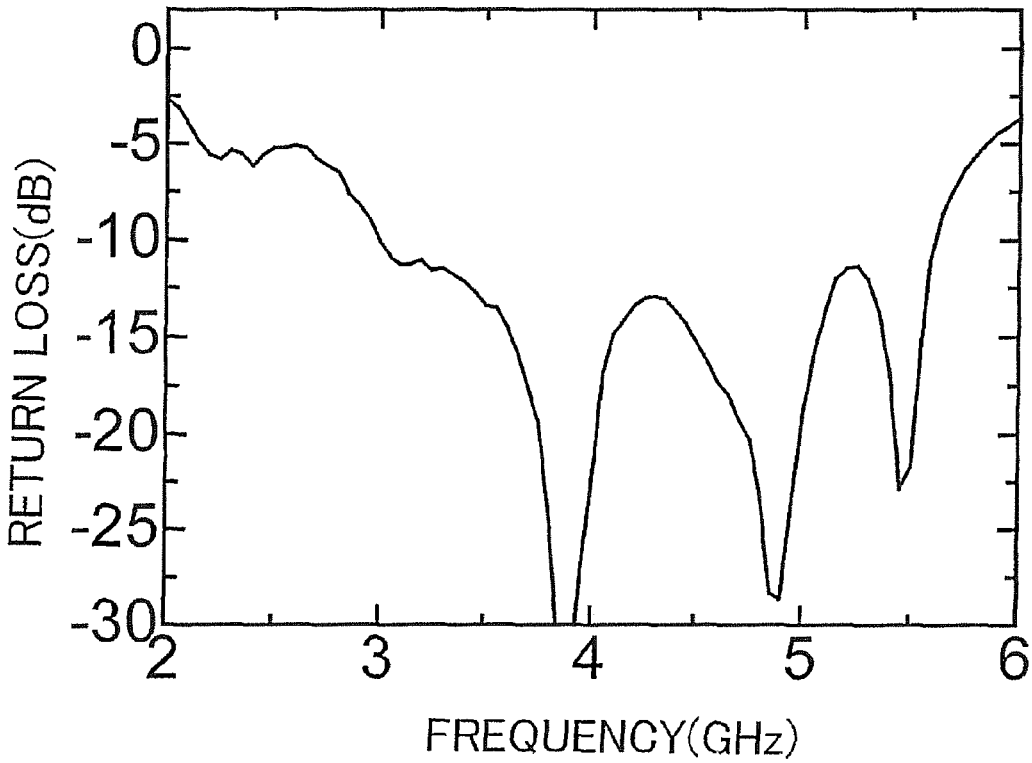
FIG. 27 is an explanatory view of return loss characteristics of the antenna according to the fourteenth embodiment.

FIG. 27 shows the return loss characteristics in the configuration of FIG. 26. It is assumed that the printed board 200 has a dimension of width×length×thickness of 10 mm×45 mm×0.8 mm. The material of the printed board 200 is an FR-4 substrate (glass-epoxy substrate). As shown in FIG. 27, the return loss in the user frequency band (between 3.1 GHz and 4.9 GHz) is about −11 dB, which corresponds to 1.8 or less in terms of VSWR. Such satisfactory VSWR can be obtained and therefore the power reflected by the antenna due to impedance mismatching is reduced, thereby enhancing the radiation efficiency and gain of the antenna.

With the configuration in which the ground plate (201) for the components such as the LSI for UWB implemented on the printed board (200) is shared by the antenna and implemented components as described above, it is possible to achieve more satisfactory VSWR characteristics, radiation efficiency, and gain.

Explanation of Configurations of Embodiments—3

As described above, the arrangement and number of the stub conductors like the stub 203 shown in FIG. 26 are not limited to those illustrated. In the following, embodiments in which the arrangement or number of the stub conductors (203) has been modified from the configuration of the antenna 114 will be described with reference to FIGS. 28, 29, and 30.

Figure 28:
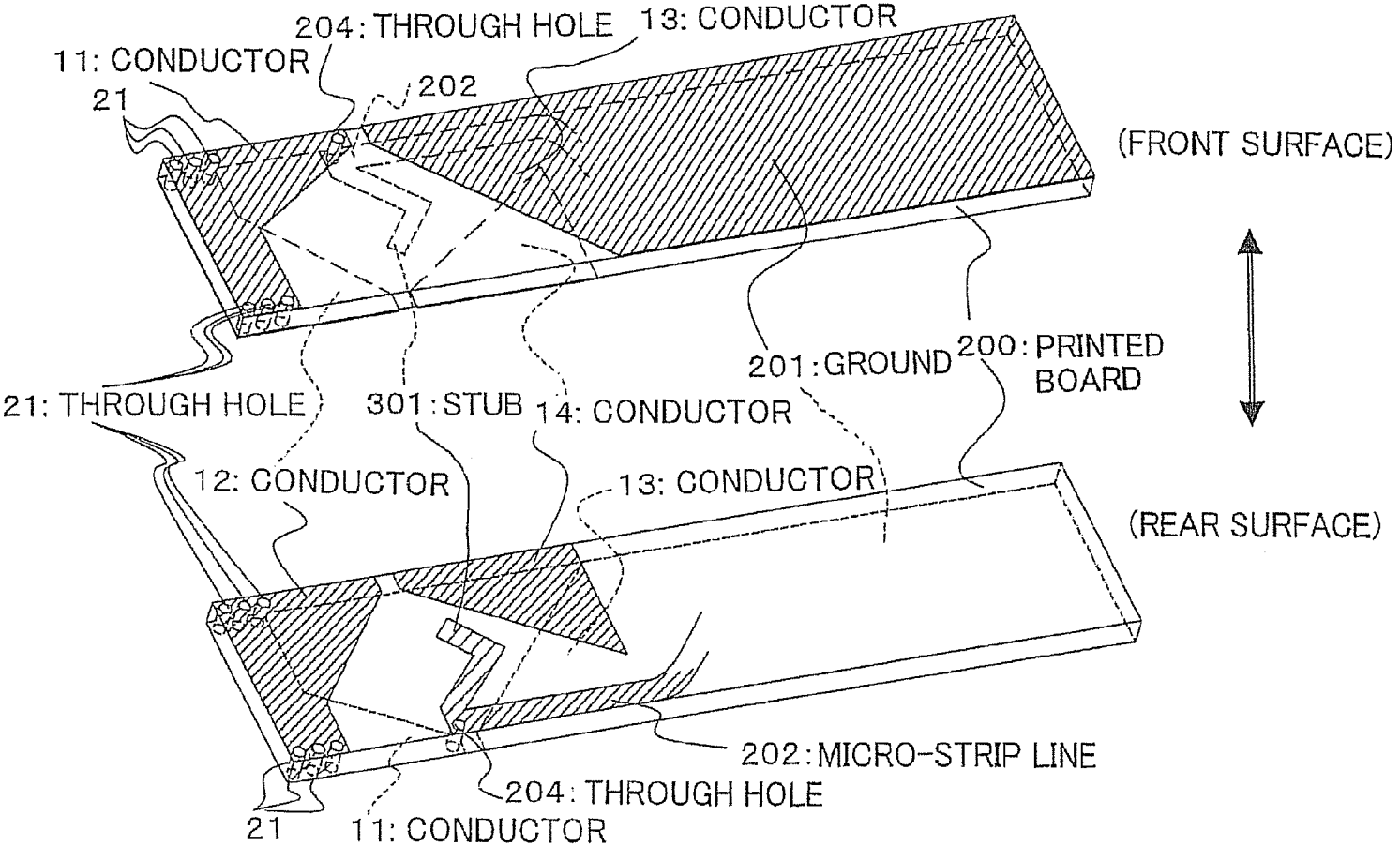
FIG. 28 is a configuration view showing both sides of the antenna according to a fifteenth embodiment.

FIG. 28 shows a configuration of a fifteenth embodiment of the present invention. FIG. 28 collectively shows conductor patterns formed on the front and rear surfaces of an antenna 115 according to the present embodiment. The above-mentioned antenna 114 (FIG. 26) has the stub 203 extending from the conductor 13, while the antenna 115 of the present embodiment has a stub 301 extending from the micro-strip line 202 on the rear surface of the printed board 200 as shown in FIG. 28. The stub 301 has a hook-like shape like the stub 203 and bending direction thereof is set such that the leading end of the stub faces the conductor 11 (that is, such that the leading end thereof extends in substantially parallel to the diagonal line of the conductor 11) via the printed board 200.

Figure 29:
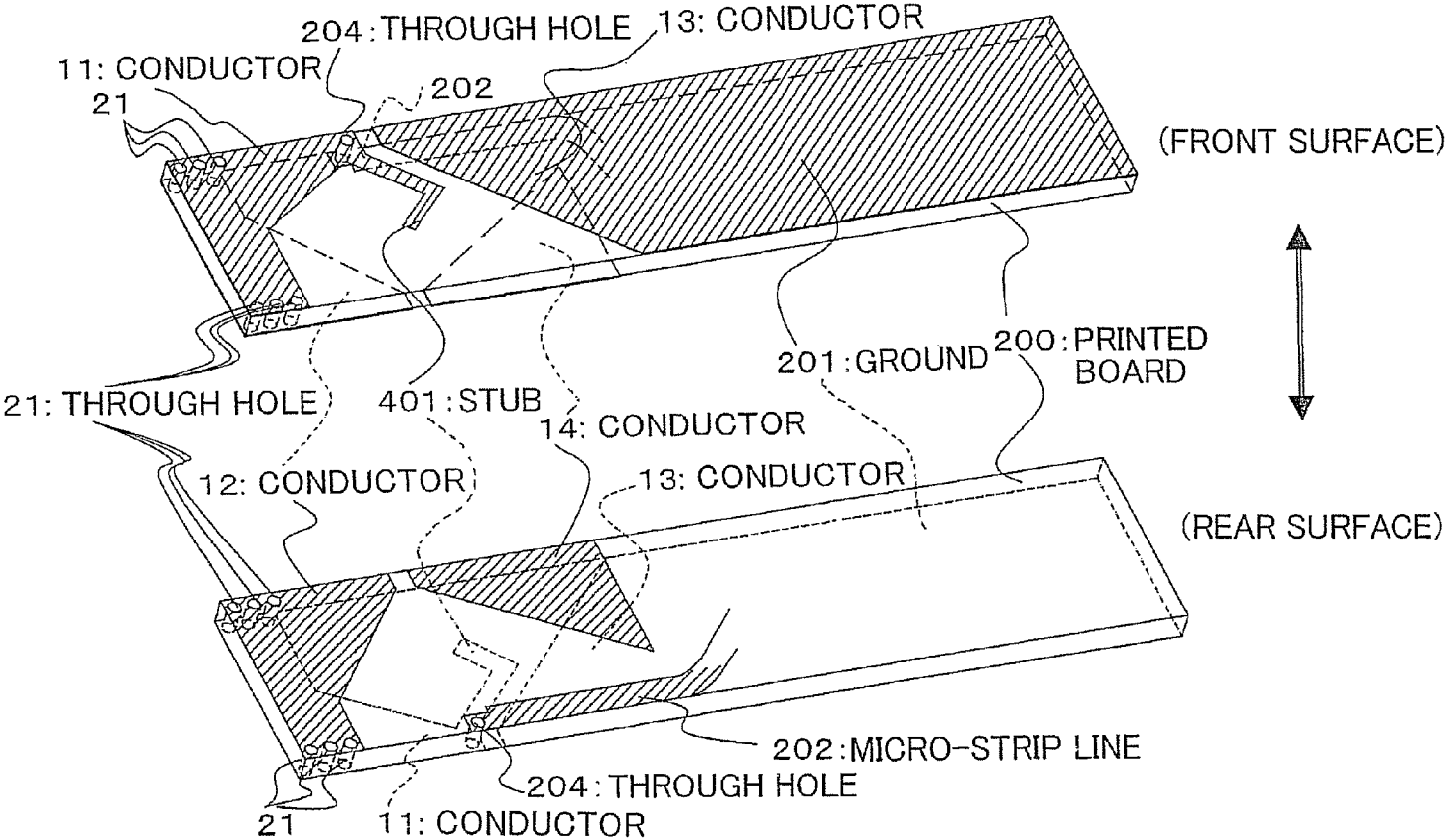
FIG. 29 is a configuration view showing both sides of the antenna according to a sixteenth embodiment.

FIG. 29 shows a configuration of a sixteenth embodiment of the present invention. FIG. 29 collectively shows conductor patterns formed on the front and rear surfaces of an antenna 116 according to the present embodiment. The antenna 116 of the present embodiment has a hook-like stub 401 extending from the tapered apex of the conductor 11, i.e., near the through hole 204 on the front surface of the printed board 200. The bending direction of the stub 401 is set such that the leading end of the stub faces the conductor 11 (that is, such that the leading end thereof extends in substantially parallel to the diagonal line of the conductor 11) as shown in FIG. 29.

Figure 30:
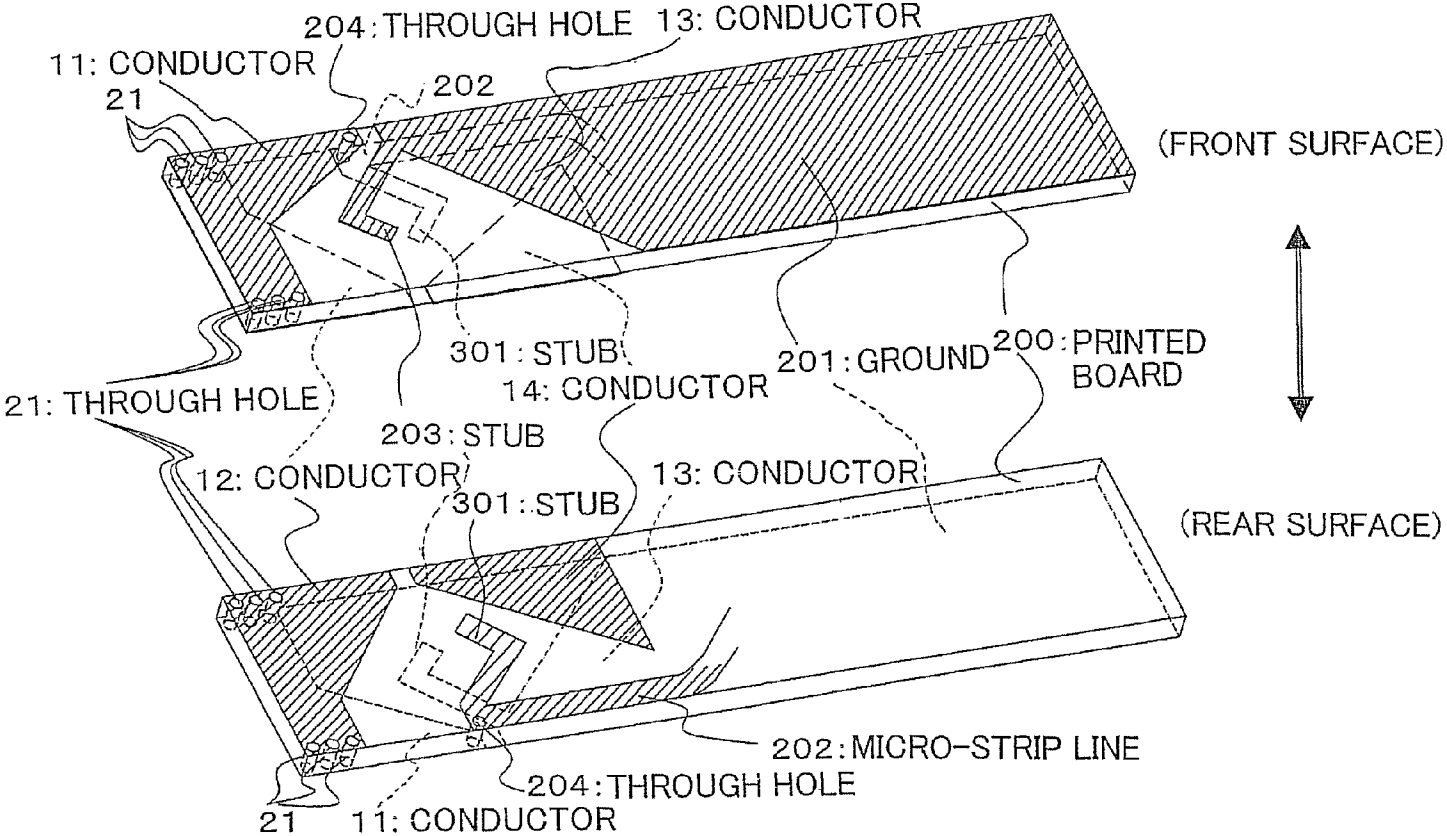
FIG. 30 is a configuration view showing both sides of the antenna according to a seventeenth embodiment.

FIG. 30 shows a configuration of a seventeenth embodiment of the present invention. FIG. 30 collectively shows conductor patterns formed on the front and rear surfaces of an antenna 117 according to the present embodiment. The antenna 117 of the present embodiment has the above-mentioned stub 203 (FIG. 26) extending from the conductor 13 on the front surface of the printed board 200 and stub 301 (FIG. 28) extending from the micro-strip line 202 on the rear surface of the printed board 200.

The configuration obtained by modifying the arrangement or number of the stub conductors (203) from the antenna 114 shown in FIG. 26 is not limited to those illustrated in FIGS. 28 to 30 but may be changed as needed depending on the convenience of the impedance matching.

INDUSTRIAL APPLICABILITY

The small-size wide band antenna of the present invention can suitably be applied to usages requiring small-size and wide range frequency band, and suitably be used as an antenna for use in a UWB radio technique, antenna for wireless LAN, antenna for receiving terrestrial digital TV broadcasting, antenna for mobile telephone, and the like.

What is claimed is:

1. A small-size wide band antenna comprising:

a radiating element formed on a dielectric substrate; and a power supply unit for supplying dipole potential to the radiating element, wherein the radiating element includes a ground potential section having a power supply point to which a ground potential is supplied from the power supply unit and an opposite-pole potential section having a power supply point to which a potential forming a pair with the ground potential is supplied from the power supply unit, wherein each of the ground potential section and opposite-pole potential section includes a pair of conductors which are formed in a tapered shape on front and rear surfaces of the dielectric substrate and are mutually capacitively coupled, and the power supply points of the ground potential section and opposite-pole potential section are positioned at tapered apexes of the conductors formed on the same side of the dielectric substrate, wherein the pair of conductors constituting each of the ground potential section and opposite-pole potential section are arranged such that each conductor has substantially a right angle shape in which one of the sides forming the tapered shape is set as the hypotenuse and that the hypotenuse of one conductor crosses that of the other conductor.

2. The small-size wide band antenna according to claim 1, further comprising an impedance matching section for matching an impedance between the radiating element and power supply unit.

3. The small-size wide band antenna according to claim 2, wherein the impedance matching section includes a side surface conductor which is formed on the side surfaces of the dielectric substrate, and connected to the pair of conductors constituting the opposite-pole potential section, and which short-circuits the pair of conductors constituting the opposite-pole potential section, wherein the pair of conductors constituting the opposite-pole potential section have protruding portions on their hypotenuse, and the protruding portions are connected respectively to the side surface conductor.

4. The small-size wide band antenna according to claim 2, wherein the impedance matching section includes a through hole which is formed in the dielectric substrate, and which short-circuits the pair of conductors constituting the opposite-pole potential section, and wherein the pair of conductors constituting the opposite-pole potential section have protruding portions on their hypotenuse, and the protruding portions are connected respectively to the through hole.

5. The small-size wide band antenna according to claim 3, wherein the impedance matching section includes a stub conductor extending from one of the conductors constituting the opposite-pole potential section and having an open end.

6. The small-size wide band antenna according to claim 1, wherein the power supply unit is a coaxial cable including a center conductor which is connected to one of the conductors constituting the opposite-pole potential section and an external conductor which covers the center conductor and supplies the ground potential section with a ground potential.

7. The small-size wide band antenna according to claim 1, wherein the power supply unit is a micro-strip line formed on the dielectric substrate.

8. A radio communication device comprising the small-size wide band antenna as claimed in claim 1 and a radio communication circuit section formed by using the dielectric substrate of the small-size wide band antenna.

9. The small-size wide band antenna according to claim 7, wherein the micro-strip line includes a conductor extending from one of the conductors constituting the opposite-pole potential section and a conductor short-circuited with one of the conductors constituting the ground potential section by a through hole formed in the dielectric substrate, wherein the micro-strip line includes a first conductor short-circuited with one of the conductors constituting the opposite-pole potential section by a through hole formed in the dielectric substrate and a second conductor which is integrated with one of the conductors constituting the ground potential section and on which a radio communication circuit is mounted, and wherein the impedance matching section includes a hook-like stub conductor which extends from one of the conductors constituting the opposite-pole section arranged on the same side of the dielectric substrate on which the second conductor is formed and has an open end, and the hook-like stub conductor is bent such that the leading end thereof faces one of the conductors constituting the opposite-pole potential section.

10. A small-size wide band antenna comprising:

a radiating element formed on a dielectric substrate; and a power supply unit for supplying dipole potential to the radiating element, wherein the radiating element includes a ground potential section having a power supply point to which a ground potential is supplied from the power supply unit and an opposite-pole potential section having a power supply point to which a potential forming a pair with the ground potential is supplied from the power supply unit, wherein each of the ground potential section and opposite-pole potential section includes a pair of conductors which are formed in a tapered shape on front and rear surfaces of the dielectric substrate and are mutually capacitively coupled, and the power supply points of the ground potential section and opposite-pole potential section are positioned at tapered apexes of the conductors formed on the same side of the dielectric substrate, and wherein the dielectric substrate has a rectangular shape, and the radiating element is formed on a rectangular antenna area defined by at least of a part of the longitudinal direction peripheral side of the dielectric substrate and at least a part of the traverse direction peripheral side thereof, the conductors having the power supply points of the ground potential section and opposite-pole potential section are arranged such that the tapered apexes thereof are positioned near the center of a first longitudinal direction side of the antenna area and that respective ones of the sides that form the tapered apexes correspond to the first longitudinal direction side of the antenna area, the conductors paired with the conductors having the power supply points of the ground potential section and opposite-pole potential section are arranged such that the tapered apexes thereof are positioned near the center of a second longitudinal direction side of the antenna area and that respective ones of the sides that form the tapered apexes correspond to the second longitudinal direction side of the antenna area, and respective other ones of the sides of the pair of conductors constituting the ground potential section that form the tapered apexes cross each other, and respective other ones of the sides of the pair of conductors constituting the opposite-pole potential section that form the tapered apexes cross each other.

11. The small-size wide band antenna according to claim 10, further comprising an impedance matching section for matching an impedance between the radiating element and power supply unit.

12. The small-size wide band antenna according to claim 10, wherein the power supply unit is a coaxial cable including a center conductor which is connected to one of the conductors constituting the opposite-pole potential section and an external conductor which covers the center conductor and supplies the ground potential section with a ground potential.

13. The small-size wide band antenna according to claim 10, wherein the power supply unit is a micro-strip line formed on the dielectric substrate.

14. The small-size wide band antenna according to claim 10, wherein the outer periphery of the radiating element is defined by a rectangle having a dimension of 0.1 wavelengths×0.2 wavelengths based on the minimum value of the use frequency.

15. A small-size wide band antenna comprising:

a radiating element formed on a dielectric substrate;

a power supply unit for supplying dipole potential to the radiating element, and an impedance matching section for matching an impedance between the radiating element and power supply unit, wherein the radiating element includes a ground potential section having a power supply point to which a ground potential is supplied from the power supply unit and an opposite-pole potential section having a power supply point to which a potential forming a pair with the ground potential is supplied from the power supply unit, wherein each of the ground potential section and opposite-pole potential section includes a pair of conductors which are formed in a tapered shape on front and rear surfaces of the dielectric substrate and are mutually capacitively coupled, and the power supply points of the ground potential section and opposite-pole potential section are positioned at tapered apexes of the conductors formed on the same side of the dielectric substrate, wherein the impedance matching section includes a stub conductor extending from one of the conductors constituting the opposite-pole potential section and having an open end, wherein the stub conductor has a hook-like shape, and wherein the stub conductor extends from the tapered apex of the conductor constituting the opposite-pole potential section and is bent in a hook-like manner such that the leading end thereof faces the conductor constituting the opposite-pole potential section.

16. The small-size wide band antenna according to claim 15, further comprising an impedance matching section for matching an impedance between the radiating element and power supply unit.

17. The small-size wide band antenna according to claim 15, wherein the power supply unit is a coaxial cable including a center conductor which is connected to one of the conductors constituting the opposite-pole potential section and an external conductor which covers the center conductor and supplies the ground potential section with a ground potential.

18. The small-size wide band antenna according to claim 15, wherein the power supply unit is a micro-strip line formed on the dielectric substrate.

19. The small-size wide band antenna according to claim 15, wherein the outer periphery of the radiating element is defined by a rectangle having a dimension of 0.1 wavelengths×0.2 wavelengths based on the minimum value of the use frequency.

* * * * *